US012208307B2

(12) United States Patent
Wald

(10) Patent No.: US 12,208,307 B2
(45) Date of Patent: Jan. 28, 2025

(54) ADJUSTABLE BENCH-CYCLING EXERCISE DEVICE

(71) Applicant: Joshua R. Wald, Brooklyn, NY (US)

(72) Inventor: Joshua R. Wald, Brooklyn, NY (US)

( * ) Notice: Subject to any disclaimer, the term of this patent is extended or adjusted under 35 U.S.C. 154(b) by 0 days.

(21) Appl. No.: 17/803,309

(22) Filed: May 3, 2022

(65) Prior Publication Data

US 2023/0356026 A1 Nov. 9, 2023

(51) Int. Cl.
*A63B 22/06* (2006.01)
*A63B 71/06* (2006.01)

(52) U.S. Cl.
CPC ..... *A63B 22/0605* (2013.01); *A63B 71/0619* (2013.01); *A63B 2022/0617* (2013.01); *A63B 2022/0623* (2013.01); *A63B 2022/0652* (2013.01); *A63B 2208/0252* (2013.01); *A63B 2208/0257* (2013.01); *A63B 2225/09* (2013.01)

(58) Field of Classification Search
CPC ..... A63B 22/0605; A63B 71/0619; A63B 2022/0617; A63B 2022/0623; A63B 2022/0652; A63B 2208/0252; A63B 2208/0257; A63B 2225/09
See application file for complete search history.

(56) References Cited

U.S. PATENT DOCUMENTS 597,911 A 1/1898 Morris
2,316,530 A 4/1943 Nilsen
3,750,479 A 8/1973 Gause et al.
3,888,136 A 6/1975 Lapeyre
4,519,604 A 5/1985 Azounian
4,538,804 A * 9/1985 Zibell ..... A63B 22/0605 482/57
4,673,178 A 6/1987 Dwight
4,973,046 A 11/1990 Maxwell
4,976,426 A 12/1990 Szabo et al.
5,114,391 A 5/1992 Pitzen et al.
5,160,305 A * 11/1992 Lin ..... A63B 21/4047 482/142
5,449,334 A * 9/1995 Kingsbury ..... A63B 22/0605 601/36
5,470,295 A 11/1995 Wang
5,551,934 A * 9/1996 Binette ..... A63B 21/4037 482/130
5,556,589 A 9/1996 Sibal
5,569,128 A 10/1996 Dalebout
5,636,554 A 6/1997 Amey
(Continued)

*Primary Examiner* — Loan B Jimenez
*Assistant Examiner* — Andrew M Kobylarz

(57) ABSTRACT

An exercise device with advanced bench-cycling exercises for glute, abs and leg toning, for use in both the stomach down and up positions, has: a bottom support and at least one main support stem extending upwardly; a main joint body support frame rotatably connected to the support stem to allow lower support and upper support bars to be tiltable. The upper support bar is sufficient to support at least a portion of a human torso, and is rotatably connected to the main joint; one or two lower support bars adjustable in length, and having a top portion connected to the main joint, upper support bar or the at least one support stem; and a bottom portion extended away from the main joint; two cranks located on the bottom portion of the lower support bar; and a pair of pedals separately connected to their cranks, the cranks being adjustable in length.

20 Claims, 14 Drawing Sheets

(56) References Cited

U.S. PATENT DOCUMENTS

| | | | | |
|---|---|---|---|---|
| 5,785,631 | A | 7/1998 | Heidecke | |
| 6,071,215 | A | 6/2000 | Raffo et al. | |
| 6,270,446 | B1 | 8/2001 | Abelbeck et al. | |
| 6,379,285 | B1 | 4/2002 | Maresh et al. | |
| 6,547,702 | B1 | 4/2003 | Heidecke | |
| 6,551,219 | B1 | 4/2003 | Brown | |
| 8,647,240 | B2 | 2/2014 | Heidecke | |
| 9,162,104 | B1 | 10/2015 | Lee et al. | |
| 10,029,143 | B1 | 7/2018 | Milstein et al. | |
| 10,946,239 | B2 * | 3/2021 | Berry | A63B 21/0051 |
| 2019/0105527 | A1 * | 4/2019 | Hallmark | A63B 23/0216 |
| 2021/0016130 | A1 * | 1/2021 | Cope | A63B 21/4029 |

* cited by examiner

ADJUSTABLE BENCH-CYCLING EXERCISE DEVICE

REFERENCE TO RELATED APPLICATIONS

The present application has no related applications.

BACKGROUND OF INVENTION a. Field of Invention

The present invention relates to exercise devices that have been created for bench cycling wherein a central torso support frame is used for the stomach-down position, and alternatively, for the stomach-up position (also referred to herein as "on your stomach" and "on your back" bench exercises). The present invention exercise devices have adjustable pedaling capabilities to accommodate users of different sizes and who seek different achievements. The pedals are connected to cranks that are supported by extendable (adjustable) lower support bars that extend from the torso support frame. The lower support bars are, in preferred embodiments, dual support bars that are independently mounted, and each are articulated, such as hinged in the middle, for folding up or down, and each may separately be moved horizontally and vertically and shortened or lengthened (via telescoping of articulated folding). In these embodiments, the dual lower support bars may be brought toward each other or spread apart from one another. This collectively affords for X-plane, Y-plane and Z-plane adjustments. Thus, the distance between the torso support frame and the cranks are adjustable, and the distance of the pedals from the cranks are also adjustable. Utilizing the present invention exercise devices enables an exerciser to target the full range of gluteus muscles, as well as abdominal muscles, in addition to conventional cycling muscular development and toning.

b. Description of Related Art

The following patents are representative of the field pertaining to the present invention:

U.S. Pat. No. 10,029,143 B1 to Milstein et al. describes a stationary exercise bicycle pedal system that can be easily manually modified during an exercise routine to greatly expand the number of different muscle groups that are stimulated during the exercise routine. The stationary exercise bicycle pedal system includes laterally adjustable and selectively positionable pedals received on elongated support shafts. Adjustable pedal stops are received on each elongated support shaft and are provided on each side of each pedal to lock or hold the respective pedal in a specific location along the respective elongated support shaft. The adjustable pedal stops are manually adjustable along a length of the respective elongated support shaft so that the respective pedal can be selectively positioned anywhere along the respective elongated support shaft and varied during the exercise routine.

U.S. Pat. No. 9,162,104 B1 to Lee et al. describes an inverted exercise cycling assembly that allows a user to exercise their lower body while lying with a back to a ground surface. The assembly includes a support assembly configured for positioning upon a ground surface. A post is coupled to the support assembly. A cycling frame is coupled to the post. A flywheel is rotatably coupled to the cycling frame. A pair of pedals is coupled to the cycling frame and mechanically coupled to the flywheel such that rotation of the pedals rotates the flywheel. A rear axle is coupled to the cycling frame and extends between the pedals. The rear axle is operationally coupled to the pedals wherein the pedals urge the rear axle to rotate. A front axle is coupled to the cycling frame and extends through the flywheel. The front axle is operationally coupled to the pedals wherein the pedals urge the front axle to rotate.

U.S. Pat. No. 8,647,240 B2 to Heidecke describes an exercise device which includes a surface for supporting a body of a user and a frame(s) for supporting the surface(s) above a floor. Resistance device(s) are connected to the device for providing resistance to movement of the user. Device(s) for adjusting the surface(s) relative in distance to the resistance device(s) during an exercise routine. Device(s) may be provided for adjusting the surface(s) relative in distance to the resistance device(s) during an exercise routine and or relative to the floor. Device(s) may be provided for adjusting the surface(s) closer in relative distance to the resistance device(s) while the orientation of the surface changes from vertical thru horizontal and for adjusting the surface(s) further in relative distance to the resistance device(s) while the orientation of the surface changes from horizontal thru vertical during an exercise routine and or relative to the floor.

U.S. Pat. No. 6,551,219 B1 to Brown describes an exercise or physical therapy apparatus that provides both tonic and phasic exercise to selected muscle groups of a user, such as the muscles of the arms or legs. The phasic exercise may be accomplished by a cycle. The tonic exercise is accomplished by subjecting the muscle group to a constant load, such as a user- or therapist-selected portion of the user's body weight, by springs, or by weights. A measurement device measures the degree of displacement of the user's torso, it being an objective of the user to keep the torso stationary.

U.S. Pat. No. 6,547,702 B1 to Heidecke describes an exercise device which includes a surface for supporting a body of a user and a frame(s) for supporting the surface(s) above a floor. Resistance device(s) are connected to the device for providing resistance to movement of the user. A mechanism(s) may be provided for changing the orientation of the surface relative to the floor during an exercise routine. Also, mechanism(s) may be provided for changing the orientation of the resistance devise(s) relative to the floor during an exercise routine. And mechanism(s) may be provided for changing the orientation of the surface(s) and the resistance devise(s) relative to the floor and to each other during an exercise routine. The resistance devise(s) may include component(s) for converting user motion into energy, electricity, etc. to power the exercise devise. Display device(s) may be provided to display various information relating to an exercise routine(s) to the user and to other(s). Computer control(s) may be included for controlling the amount of resistance provided by the resistance device(s) and for controlling the orientation of the support surface(s) relative to the floor and to hip extension and flexion. Memory device(s) may be associated with the computer control for storing exercise routine(s), recording the results of performed exercise routines and other information. Input device(s) may be provided with the computer control for user input information and output device(s) may also be associated with the computer control for outputting the results of performed exercise routine(s) and other information.

U.S. Pat. No. 6,379,285 B1 to Maresh et al. describes an exercise apparatus that has (a) a bi-modal seat that readily transforms between a first configuration, which is adapted for conventional cycling, and a second configuration, which is adapted for recumbent cycling; (b) a bi-modal flywheel assembly that readily switches between a direct drive configuration and a free-wheel configuration; and/or (c) a braking assembly which readily stops rotation of the flywheel at the discretion of a user.

U.S. Pat. No. 6,270,446 B1 to Abelbeck et al. describes an exercise device capable of providing aerobic exercise and abdominal muscle conditioning. The device is comprised of an upper frame and a lower frame. The upper frame includes a seat back which supports the upper portion of the torso of a user. The lower frame includes a pelvis support and a bicycle pedaling mechanism. The preferred embodiment includes a linkage system that connects the upper frame to the lower frame. This linkage is capable of providing a translating center of rotation when the upper frame rotates with respect to the lower frame. This is done to follow the body's translating center of rotation during trunk flexion. An alternative to the preferred embodiment includes a arcuate roller attached to the upper frame. This arcuate roller is preferably received by a track on the lower frame, and though preferable, the track is not necessary in order to achieve a translating center of rotation and therefore not necessary to the function of the invention. The upper frame and the lower frame are pivotally mounted one to another thus allowing the device to fold onto itself for easy storage.

U.S. Pat. No. 6,071,215 to Raffo et al. describes a multi-mode exercise machine that has a re-configurable arm member operable in alternate upstanding and recumbent configurations that allows the machine to be used, when the re-configurable arm member is configured in its upright configuration, to provide a first mode of exercise where the user is supported in such an upright position as to be able to exercise at least his/her lower body, and that allows the machine to be used, when the re-configurable arm member is configured in its recumbent configuration, to provide a second mode of exercise, where the user is supported in such a recumbent position as to allow the user to exercise at least his/her upper body. In the presently preferred embodiment, the re-configurable arm member includes a pivotally mounted and self-locking arm member movable between a first, upright position and a second, recumbent position. In the presently preferred embodiment, the first and second exercise modes include cycling and rowing exercise modes.

U.S. Pat. No. 5,785,631 to Heidecke describes an exercise device which includes a surface for supporting a body of a user and a frame for supporting the surface above a floor. Mechanism(s) may be provided for changing the orientation of the surface relative to the floor during an exercise routine. Resistance device(s) are connected to the device for providing resistance to movement of the user. Display device(s) may be provided to display various information relating to an exercise routine to the user and to others. Computer control(s) may be included for controlling the amount of resistance provided by the resistance devices and for controlling the orientation of the support surface relative to the floor. Memory device(s) may be associated with the computer control for storing exercise routines, recording the results of performed exercise routines and other information. Input device(s) may be provided with the computer control for user input information and output device(s) may also be associated with the computer control for outputting the results of performed exercise routines and other information.

U.S. Pat. No. 5,636,554 to Amey describes a variable length crank arm assembly for transferring energy to the power train of a bicycle, the assembly including a primary crank arm attached to a secondary crank arm by a rotatable coupling. The rotatable coupling enables the secondary crank arm to be rotated to extended and retracted positions during the power and unloading strokes of a pedal cycle. The variable length crank arm is biased to impart a continuous force to rotate the secondary crank arm toward its retracted position, and a stop limits the rotation of the secondary crank arm to establish the extended and retracted positions.

U.S. Pat. No. 5,569,128 to Dalebout describes a multipurpose pedal-type exercise device comprising a frame having a seat thereon, a pedal assembly having an adjustable resistance, and a multiposition adjustment mechanism connecting the pedal assembly to the frame to provide the user the capability of adjusting the position of the pedal assembly to compensate for the variation in the user's position during use of the pedal assembly.

U.S. Pat. No. 5,556,589 to Sibal describes a device for spinning fibers, especially bicomponent fibers having a sheath/core configuration. The device has, in a preferred embodiment, disposed in the spinneret orifices a grooved pin with an axial bore (a hollow pin). A polymer distribution assembly is provided for directing separate sheath and core compositions to the grooves and the bore, respectively, such that the sheath and core compositions are co-spun from the spinneret orifice. The device can be easily disassembled and a different pin configuration inserted to alter the geometry and/or ratio of the sheath and/or core sections of the fiber.

U.S. Pat. No. 5,470,295 to Wang describes a rowing exercise machine that comprises a base, a first swinging member, a second swinging member, a seat tube, a seat, a third swinging member, a first pulley, a second pulley, a pull cable, a hand grip, and two pedals. A rowing exercise is brought about by a person sitting on the seat of the rowing exercise machine, with the person's feet pedaling the pedals and the person's hands holding the hand grip to pull rearwards the pull cable to cause the first swinging member and the third swinging member to move closer so as to actuate the seat tube to move upwards and rearwards. As the pull cable is relieved of the pressure exerting thereon, the seat tube is caused by, the person's weight to move forwards and downwards so as to actuate the first swinging member and the third swinging member to move away from each other in opposite directions.

U.S. Pat. No. 5,449,334 to Kingsbury describes a rotatable exercise apparatus for rotating a user in such a manner that the user's center of gravity is offset with respect to the user's center of rotation, while simultaneously exercising the user's arms, legs, stomach, back, side and neck. The rotatable exercise apparatus generally comprises a rotatable frame having an outwardly facing user support for offsetting the user's center of gravity from the user's center of rotation, a frame support structure, and a means for rotating the frame. The rotatable exercise apparatus provides a strenuous, low impact, complete physical work out which simulates the exercise and exertion which may be experienced by the human body, while participating in sailing-type activities.

U.S. Pat. No. 5,160,305 to Lin describes a multifunctional gym exerciser with an adjustable table having a semicircular set plate on a front edge of the main body of the multifunctional exerciser and a plurality of set holes on the circumference of the set plate, so that, by utilizing a combination of a set bolt with the set plate, a user can optionally secure various exercise attachments, such as a pedal assembly, a leg lift assembly and a sit up support according to different exercise requirements. Furthermore, through the use of a movable supporting stand located at the bottom edge of the main body, the table position can be widely adjusted, and a seat and rest seat can also be adjusted to a desired slope in order to achieve the best exercise effect.

U.S. Pat. No. 5,114,391 to Pitzen et al. describes an exercise device providing mechanical actions for independent or simultaneous exercise of the upper and lower body of a human user. Each action incorporates a mechanical movement converting output of the user to rotational motion and thereby powering one of two electrical generators. An exercise controller selects loads to be applied to the generators. The loads are coupled by the mechanical movements back to the user to provide resistance to the exercise effort. The exercise controller drives an electronic display which informs the user of his or her intensity of effort as well as the proportion of that effort being met through exercise of the upper body and the part being met through exercise of the lower body.

U.S. Pat. No. 4,976,426 to Szabo, deceased, et al. describes an exercise device that offers different levels of exercise to an individual and can be arranged as an exercise device for bedridden patients and those in different stages of rehabilitation. The device comprises an exercise head having at least one pair of crank arms for rotation of limbs of the individual about an axial shaft. A hydraulic motor is linked to the axial shaft to rotate the crank arms with hydraulic power source for the motor. Rotational speed of the axial shaft is set by a speed adjustment arrangement associated with the hydraulic motor. A force adjustment system adjusts the force applied to the limbs through the crank arms to rotate the axial shaft beyond a set rotational speed. Variation in the speed of the axial shaft is sensed by a speed sensing arrangement. A system for sensing force to sense variation in force applied to the crank arms by the limbs of the individual.

U.S. Pat. No. 4,973,046 to Maxwell describes an exercise device for active or passive therapeutic exercise of human lower extremities that provides a portable base structure supporting a housing that journals a laterally similar adjustable pedal crank rotatably carrying pedals on its outer arms. Motor and drive mechanism carried by the housing power the pedal crank for rotary motion and a brake structure selectively restrains its motion. The housing is adjustably positionable relative the base about three perpendicular intersecting axes and each of the laterally opposed pedal crank arms are compound elements interconnected by adjustment structures allowing positioning of each of three elements forming each pedal crank arm about two mutually perpendicularly axes. Pedal structures, adjustable for foot size, are rotatably mounted on the opposed lateral elements of the pedal crank. Each pedal structure mounts a pedal plate for universally adjustable motion relative to the pedal crank to adjust the plane of contact of a user's foot therewith.

U.S. Pat. No. 4,673,178 to Dwight describes an exercise machine assembly (10) that includes a body portion (12), handlebars (16) mounted on the body portion (12) and a seat (18). A pair of crank arms (26) are supported by the body portion (12) for rotational movement. A foot pedal (28) is mounted on an axle member (30) extending from each of the crank arms (26). The thot pedals (28) are mounted on adjustable supports for adjustably supporting each of the foot pedals (28) at any one of a plurality of positions along the entire length of the crank arm (26).

U.S. Pat. No. 4,519,604 to Arzounian describes an exercise machine that includes a set of pedals which are rotatable by the user, and a crib for supporting the user in the supine position. The crib and pedals oscillate simultaneously in opposite directions under motive power of the pedals.

U.S. Pat. No. 3,888,136 to Lapeyre describes a pedal and crank arm system for bicycles and the like to provide rugged yet safe and easy means for adjusting the effective length of the pedal arms in one quick step if preferred to whatever extent desired within the limits of the full adjustment range, while automatically maintaining the two pedals an equal distance from the axis of the drive shaft at all times. The system further provides simple and positive locking means for insuring fixed effective pedal arm length during pedaling. The locking means may be easily and quickly disengaged and pedal position adjusting means actuated by the feet of the cyclist either when bicycle is at a standstill or in motion, thereby leaving both hands of cyclist available for guiding and braking. The devices of this disclosure may be installed as original equipment or provided in kit form for modifying bicycles which have other pedal and sprocket arrangements.

U.S. Pat. No. 3,750,479 to Gause et al. describes an apparatus for testing the human body in a variety of positions, ranging from the vertical to the supine, while exercising on an ergometer; and can also be used for angular positioning of other biomedical devices. It includes a floor plate and a hinged plate upon which to fix the ergometer, a back rest and a head rest attached at right angles to said hinged plate and behind the seat of the ergometer, dual hydraulic cylinders for raising and lowering the hinged plate through 90.degree. by means of a self contained hydraulic system, with valve means for control and positive stops on the apparatus to prevent over travel. Tests can be made with the subject positioned on the seat of the ergometer, through the various angles, with a substantially normal body attitude relative to said seat and ergometer.

U.S. Pat. No. 2,316,530 to Nilsen describes, in a bicycle drive unit, the combination with a pedal shaft having a sprocket gear secured thereto and mounted for rotation and a pair of rigid pedal arms each having secured to one end a foot pedal, of an elongated member secured intermediate its ends to said shaft and having the other end of one of the arms pivoted to one end thereof, the other end of the other pedal arm being pivoted on the sprocket gear eccentrically of the axis of rotation of the shaft, and spring tensioned devices pivoted to said arms closer to said pedals than to the pivots of the arms and one of said tensioned devices pivoted on the sprocket gear eccentrically of the axis of rotation of the sprocket gear and the shaft and the other tensioned device pivoted on the other end of said elongated member eccentrically of the axis of rotation of the shaft, said spring tensioned devices each including a stop nut and a spring tension adjusting nut, said nuts being manually adjustable to render the tensioned devices operable and inoperative.

U.S. Pat. No. 597,911 to Morris describes, in a velocipede-crank, the combination of a crank-arm, a leverage-increasing arm pivotally connected with the crank-arm between the ends thereof and provided with a pedal, and a spring between the outer end of the crank-arm and the leverage-increasing arm whereby the leverage of the crank may be increased against the resistance of the spring and the outer end of the crank-arm will form a positive stop to farther forward swing of the leverage-increasing arm when the resistance of the spring is overcome.

Notwithstanding the prior art, the present invention is neither taught nor rendered obvious thereby.

SUMMARY OF INVENTION

The present invention relates to an exercise device to provide a user with advanced bench-cycling exercises as well as glute toning and abs toning, for use in both the stomach-down and stomach-up positions. Thus, the present invention is not a stationary bicycle device, but a multi-faceted bench exercise device based on cycling. The present invention includes: a) a bottom support and at least one main support stem extending upwardly therefrom; b) a main joint and body support frame connected to said at least one main support stem; c) an upper support bar having sufficient size to support at least a portion of a human torso of said user, said upper support bar being rotatably connected to said main joint; d) at least one lower support bar that is adjustable in length, said lower support bar having a top portion connected to one of said main joint, said upper support bar and said at least one support stem, and having a bottom portion extended away from said main joint; e) two cranks located on said bottom portion of said lower support bar; and f) a pair of pedals separately connected to one of said two cranks, wherein each of said cranks is adjustable in length. In some embodiments, the main joint and body support frame is fixed, as are an upper support bar and lower support bar(s) to inhibit rotation; in other embodiments, the connection at the main joint and body support frame (to one or more adjacent components) affords upward and downward rotation of the upper and/or lower support bars. Thus, preferred is the rotatable connection made so as to allow at least one of the lower support and upper support bars to be tiltable, and most preferably, both. In the rigid embodiments, the upper support bar, or a portion of the lower support bars, may be integrally formed with the main joint.

In some preferred embodiments of the present invention exercise device, the upper support bar includes expandable, contractable sides to accommodate users of different sizes. In some embodiments, the upper support bar includes an expandable top. In some embodiments, the upper support bar includes a headrest. In some embodiments there is a hip support.

In some embodiments of the present invention exercise device, the upper support bar includes extended arms with hand grips. In some preferred embodiments of the present invention exercise device, the upper support bar extended arms have at least two positions, one being a contracted position and one being a protracted position relative to the upper support bar, to accommodate stomach-down use and stomach-up use. In some alternative embodiments, there are elbow supports connected to the upper support bar.

In some preferred embodiments of the present invention exercise device, the at least one lower support bar has two bar segments that are lockably articulated relative to one another to permit complex angles and positions. In some preferred embodiments of the present invention exercise device, the at least one lower support bar is connected to one of said upper support bar, main joint and said at least one support stem, with a rotatable, lockable ring for rotational movement thereof relative to the upper support bar. By "ring" is meant a closed circle or a segment (arc) thereof that is used to create a joint for moveable, articulated bars/other components. In other preferred embodiments, the main joint is a set of lockable rings. In other embodiments, the main joint may be any lockable connection that allows for rotation, such as a lockable hinge, ball joint, axle or otherwise.

In other preferred embodiments of the present invention exercise device, the device is for providing a user with advanced bench-cycling exercises as well as glute toning and abs toning, for use in both the stomach-down and stomach-up positions, and to provide X-plane, Y-plane and Z-plane adjustability. The embodiments include: a) a bottom support and at least one main support stem extending upwardly therefrom; b) a main joint and body support frame rotatably connected to said at least one main support stem so as to allow lower support and upper support bars to be tiltable; c) an upper support bar having sufficient size to support at least a portion of a human torso of said user, said upper support bar being rotatably connected to said main joint; d) two separate lower support bars that are adjustable in length, each of said lower support bars having a top portion connected to one of said upper support bar, main joint and said at least one support stem, and each of said support bars having a bottom portion extended away from said torso support frame, and each of said two separate lower support bars having independent rotational mechanisms for movement in X-plane, Y-plane and Z-plane for three dimensional adjustability and for angle changes between each of said two separate lower support bars; e) two cranks located on said bottom portion of said lower support bar; and f) a pair of pedals separately connected to one of said two cranks, wherein each of said cranks is adjustable in length. For example, the crank arms or shafts of the crank may be telescopic or folding.

These present invention X-plane, Y-plane and Z-plane adjustable embodiments may have any of the additional features and components described above. In some of these embodiments, each of the two lower support bars has two bar segments that are lockably articulated relative to one another to permit complex angles and positions and each of the two lower support bars is connected to one of: the upper support bar, main joint and said at least one support stem, with a rotatable, lockable ring, such as at the main joint or at a knee joint-articulated lower support member, for rotational movement thereof relative to one another.

In some preferred embodiments of the present invention, each crank is lockably telescopic and each pedal and crank may be independently lockable at any angle, relative to the other pedal or crank. In some embodiments, each of said cranks includes a variable resistance mechanism.

In most preferred embodiments of the present invention, the exercise device further includes pedal distance and resistance monitoring, display and control. In some embodiments, the exercise device further includes a memory for storying, retrieving and displaying pedal distance and resistance history, crank positions, crank rotary resistance in fixed or variable increments and powering down either of the cranks independently before, during, or after use.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

Figure 1A:
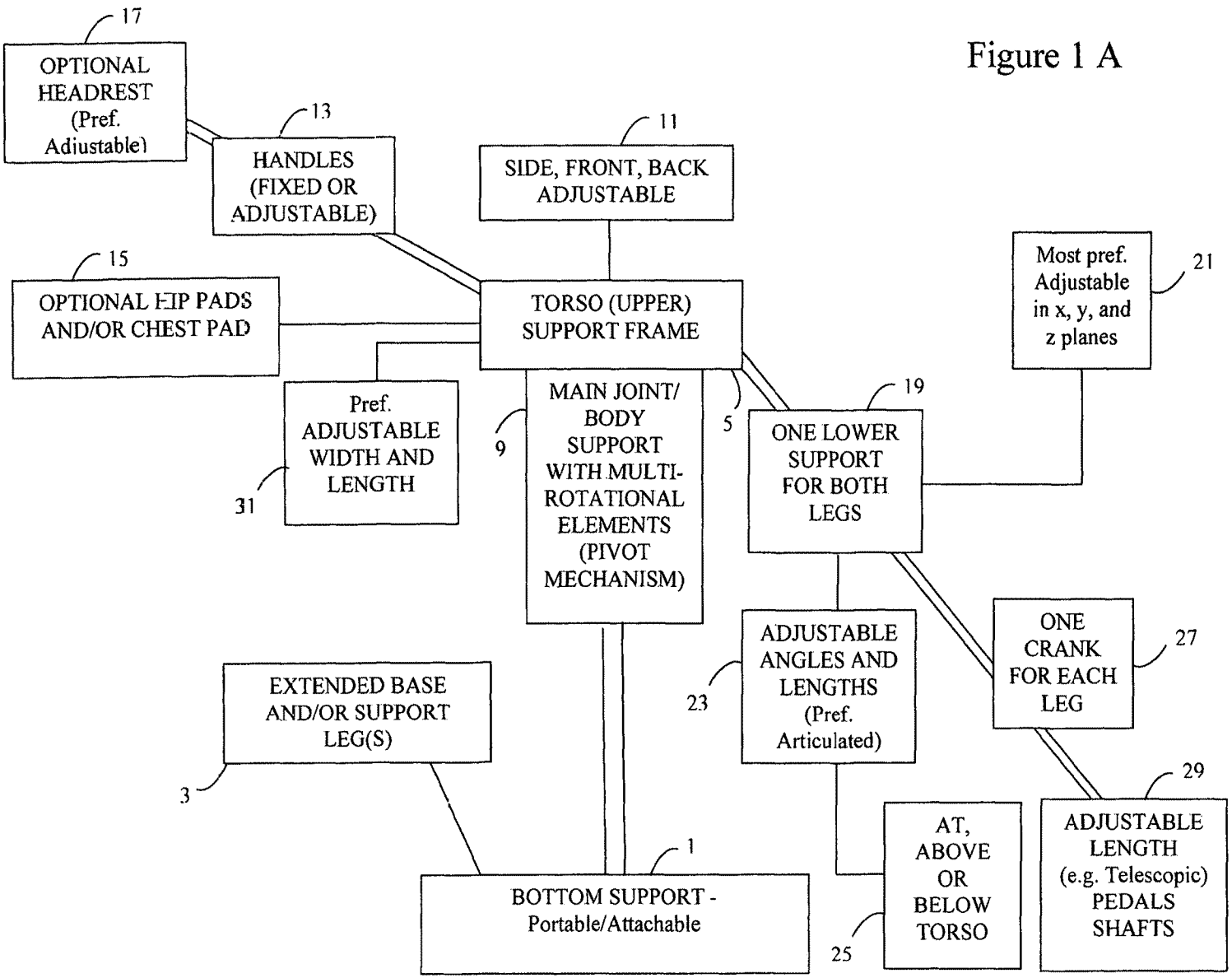
FIG. 1A is a block diagram illustrating the essential features and other features of the present invention exercise device to provide a user with advanced bench-cycling exercises as well as glute toning and abs toning, for use in both the stomach-down and stomach-up positions, wherein there is rotation at the joint (torso support frame) via a pivot mechanism.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

DETAILED DESCRIPTION OF THE EMBODIMENTS

The present invention exercise device is an advancement in glute exercise, as well as torso, and leg muscle exercise. Further, the present invention exercise device maybe utilized with the stomach/face facing the floor (on your stomach), or facing the ceiling (on your back). Due to its many unique features, the present invention exercise equipment offers optional headrest, handles that may be fixed or adjustable, and a lower support member(s) for both legs. The lower support member(s) may be a single member for both legs or two separate lower support members, one for each leg. These lower support members, when dual components, can be fixed parallel, fixed with an angle between each other, or adjustable angle between each other. Additionally, not only are the two separate lower support members preferred and are structured to spread with adjustable angles between each other, but also preferred are adjustable lower support members that may be independently rotated upwardly or downwardly so as to permit angle changes between each other into different planes (dimensions). Further, the knee joint (articulated lower support bars) allows for each independent support bar to pivot mid-bar up or down to provide adjustments that may be needed in going from stomach down to stomach up mode and vice versa. This also provides for complex configurations to target or isolate specific muscles, or groups of muscle independently. It is an ergonomic, fully adjustable machine that's capable of full range motion in at least two axis planes, and preferably in three axis planes, as well as introduces the pulling motion to the glute. The "Opus" has a multiple of different settings and adjustments to target the glutes in a complete way that no other machine can. The Opus can be adjusted to fit any sized person and be used alternatively to target the abs. The preferred individual (at-home, office, gym, rehab clinic or physical therapy clinic) model is computerized to keep track of and to control statistics, to control resistance, and has the capability to connect wirelessly to other Opus devices for competition and comparing stats. Built to look slick and aerodynamic, the Opus can still be folded into fit in the corner of a room or into a closet. It can be used by any sized person and can also be used to target the abs. It is designed both for strength training purposes, toning, cardio enhancement and/or rehabilitation purposes.

This invention is a flat to inclined, laydown, fully adjustable, in-place exercise bike "bench cycle" designed to be utilized in two main use positions and is used by pedaling or "cycling" in-place.

The invention is coined the "OPUS" and will enhance and strengthen many muscles, but especially the butt (glutes) and stomach (abs) very specifically, and separately, in two very different use positions. The primary use position is face down and targets the glutes, as well as other muscles, but particularly emphasizes glute strength and enhancement. The secondary use position is face up and targets the abs, as well as other muscles. Being a dual purpose, dual position exercise device, the present invention Opus also provides all of the exercise advantages of in-place cycling. Given the many adjustment possibilities, the user will not only be able to make adjustments to fit the size of the user, but will also be able to increase or decrease muscle extension, direction, range of motion, and adjust resistance. Fully computerized, the Opus will keep track and control of all movements and statistics and is capable of connecting to other Opus wirelessly for competition and pairing. In an alternative analog version, resistance, positioning, locking and adjusting would be performed manually.

The Opus is made up of six main parts: the base, main support stem, main joint/body support, upper support bar, lower support bar, and the cranks/pedals.

The Base—The base is a lightweight sturdy support platform that may come in many forms. It could have any top view profile or footprint and must provide sufficient support for a pedestal or other upwardly extending stem. It may take one of three general functional formats-one being portable and thus requiring a broad or elongated member to prevent accidental tipping of the device; one being permanent, and thus could be smaller in footprint but includes attachment means (such as orifices for screwing to a floor or other substrate, or flanges for embedding in structural materials, or flanges that may be kept in place by overbraces). Preferred are the portable (movable) embodiments. In one preferred embodiment, the base sits raised off the ground by four legs and is the foundation of the portable Opus. The main vertical support stem raises up from the base to the main joint. The base is preferably futuristic, aerodynamic, and modern in aesthetics.

The Main Support Stem—The main support stem is one or more uprights that support the functional components of the present invention devices. Multiple uprights, dual uprights, or a single support pedestal may be used, although dual and single are preferred to afford maximum space and movement for the adjustable components. In one preferred example, the stem is a single vertical support which runs vertically from the base upwards to the main joint/torso support. The bottom of the stem is fixed to the base. The other end, the upper end, ends in a cylinder which is the foundation of the main joint. The main support stem is not adjustable itself. It is streamline aerodynamic and modern in aesthetics.

The Main Joint/Body Support Frame—The main joint sits directly on top of the main support bar and, in some preferred embodiments, is made up of multiple adjustment mechanisms that constitute the primary body support frame (it is the component set that keeps the user above the stem, via the upper and lower support bars). These multiple adjustment mechanisms are positioned so that the upper support bar (torso support bar) and the lower support bar(s) (legs and feet support(s)) are at least independently rotatable and lockable, and in some preferred embodiments, also afford spreading of dual lower support bars. In one example, the main joint is made up of three rotatable sandwiched rings about a central, stem-supported axle or cylinder. The rings slide onto the cylinder at the top of the stem and are able to pivot on the cylinder. The middle ring is attached to the upper support bar and allows the support to pivot parallel to the ground and downwardly below horizontal and upwardly above horizontal (e.g., 90 degrees to the main stem to perpendicular to the ground (in alignment with the main stem)). The middle ring also allows the upper support bar to fold over itself for storage. The two outer rings are attached to the lower support bars, left and right separately. The rings allow the supports to pivot together or separately in the full range of motion from the ground up to, for example, 135 degrees from the main stem. These rings both have hinges on them that allow the left and right sections of the lower support bars to also spread to the desired width. All actions can be made in increments and can be locked into any desired position. In some preferred embodiments, the lower support bar(s) may be swiveled relative to the upper support bar to have a user twisted left or right, at the hips, during pedaling.

The Upper Support Bar (Torso Support)—The upper support bar in its connected, rotatable, lockable position, readily and safely supports the main body, i.e., the torso of the user, or in another embodiment, specifically the hips of the user, and hence supports most of the weight of the user. The upper support bar can pivot freely from the main support bar, for example, 90 degrees to the ground through perpendicular, then fold over itself for storage. The angle of the upper support in conjunction with the angles of the two lower supports allows the Opus to target different areas of the muscles. There are preferably two different sets of "handles" attached to the upper support dedicated specifically for each of the main use positions, or, alternatively there are built in grips on the upper support bar, such as ergonomically correct hand grip cut outs (which are included herein as meant by "handles"). As another alternative, there may be one set of handles that is adjustable for comfortable use in both the stomach-down and the stomach-up exercise positions, such as ones that swing over for a higher and lower position, or ones that can slide at right or other angles up and down the upper support bar. In the preferred embodiments with two sets of, or two position, handles, the upper hand grip position is used for the primary face down glute position, and the lower grip position is used for the secondary face up abs position. In some embodiments, there are also elbow pads.

The upper support bar also holds the support pads, and in some embodiments, elbow pads, that hold the body torso comfortably in either main use position. The pad's connection to the upper support bar, preferably, may sit in the channel of a track that runs down the middle of the bar which allows the pads to be adjusted to any height or length, and therefore, accommodates different size (height and span or width) users and their ergonomics, depending on their size and on the specific exercise being performed. In some preferred embodiments, the handles are positioned and adapted to hold elbow supports (padded), and thus the torso weight maybe distributed between the hip pads and the elbow pads in the stomach-down mode.

The lower section of the support pads may also expand laterally to relieve the stomach of any resistance while using the primary use position, and/or fit the ergonomics of the different size users' buttocks when the present invention device is used in the stomach-up, abs enhancing position. There may be a hinge or other headrest connection mechanism at or near the top of the upper support bar to hold a collapsible or removable headrest sitting on its own support bar. When the headrest support bar is extended or engaged (open), its track also lines up with the track of the upper support bar for full sliding range of adjustment. In some preferred embodiments, the headrest bar can be released at the hinge, folded back, and latched to the back of the upper support bar when not in use, or for the primary use position.

Note that the head rest is sometimes only used for the secondary use position (stomach-up), for concentration on the abs. The headrest and its support bar should be retracted, lowered, removed or otherwise adjusted for the main use position, glutes (face down). In other embodiments, the headrest may have a face portal, such as a massage table headrest, and this is used for both stomach-up and stomach-down positions.

The Lower Support bar—The lower support bar may be a single bar (central, for both legs, or may be dual bars (for separate positions of each leg) or may be a hybrid lower support that is two bars that may move independently of one another or alternatively be clamped or otherwise be connected together to act as a single bar. Preferably, the lower support bar is made up of two, articulated main legs, left and right. Both legs are attached to the main joint in their corresponding sides (left and right) and can both move on two planes, X and Y, and can pivot and spread. If they are also telescopic, they can each move independently in three planes. The rings allow the supports to pivot on the Y axis together or separately the full range of motion from the ground, up to 135 degrees from the main stem. The support legs can also move on the X axis from the hinges on the main joint allowing them to spread to the desired width, targeting the outer buttocks, outer abs if face up, or inner thigh if doing leg strength training. Halfway down each leg is a joint (articulation) that allows the lower section of the lower supports, both left, and right to make further angle adjustments. Either or both of these sections are preferably telescopic or otherwise adjustable to accommodate individual's personal segmental dimensions (distance from torso to knee, from knee to foot The Lower Support bar (upper)—The upper section of the lower support bar can expand or contract in size to accommodate any user size.

The Lower Support bar (lower) The lower support bar can pivot at the joint between the upper and lower support bars to fine tune the desired workout angle, and can also in some embodiments expand or contract in size (length), e.g., by telescoping. The cranks are attached to Opus at the bottom of the lower support bar(s).

The Cranks/Pedals—The term "crank or cranks" as used herein refer to the crankarm(s) (sometimes referred to as cranks) with their attachments for connection to the lower support bar, as well as to the pedals. There are two cranks, one left and one right, and they are opposite each other like a bicycle, meaning that they are on opposite sides of the lower support bar. However, unlike a bicycle set of cranks, these may be set or fixed at 180 degrees off from each other, for traditional cycling rotation, or may be exactly 0 degree off so that the turn in parallel (ankles are always "looking at each other"). In some preferred embodiments, the Opus cranks telescope to adjust the desired radius motion, i.e., change the distance from the axis of crank rotation to the pedal axle. For example, measuring from where the cranks are connected to the lower support bar down to the axle of connection of the pedal to the crank, what applicant coins as "cranking radius", this distance could be adjusted from 12" to 22". While this feature is essentially for body size and comfort adjustment, it can also be used to afford a user different cranking radii for different purposes, i.e., for targeting different muscles and extending and/or contracting range of motion. Longer cranking radii allow for more extended workouts on the muscles. Shorter cranking radii do not stretch the muscles as much, but may increase the rotations per minute. The cranks work independently of each other (unlike a bicycle) so that when the lower support legs are spread to various widths by lower support bar adjustments, the cranks still work. Also, development of range of motion increases are readily achieved with these unique present invention features. The cranks hold The Opus pedals, which are available in two models. One has adjustable clips to allow any size foot or shoe to slip in, yet be snug enough for cycling use, the other holds a standard bicycle shoe clip that clips in to any standard bicycle shoes. The pedals can be interchangeable, and, thus, easily removed to accommodate any standard pedals for personal customization.

Resistance may be "computer controlled" on the pedals so that a user may build up strength over time. In one version, this adjustment feature may be totally controlled by the user, wherein the user sets the resistance and changes it as desired. In another version, programs are included that set graduated resistances over usage or time (such as is measured in miles pedaled or hours used). In a third, preferred version, the user is offered both preprogrammed regimens and self-controlled resistance adjustments. The details of controlled resistance on exercise bikes are well known, and the same arrangements may be used with the present invention devices. In addition, variable resistance may be controlled on a cycle-by cycle basis, i.e., the resistance on the uphill movement of dual pedals might be lower than the resistance on a downhill portion of a stroke or cycle, or vice versa. Such changes in resistance (by tension or compression) may be smoothly transitioned or done in step functions. The cranks also have the ability to produce "radial resistance increments" that can be controlled either manually or via the computer. Radial resistance increments can be looked at like resistance applied to the movement of clock hands, standard resistance like a standard stationary bike would be resistance equally all the way around the clock. Radial resistance increments would be resistance from 12 pm-6 pm, and then none, or little resistance from 6 pm back to 12 am, or any desired increment(s) throughout the rotation. This is also useful for rehabilitation. The phrase, "radial resistance increments" is used here to explain this feature.

The cranks could also be set to have snap back resistance (or reverse resistance) when the pedals are in unison and being used in the face up position like a leg press (unlike or opposite that of a bike). The user would push on the crank arms like a leg press, instead of the movement continuing like a bicycle would, at the end of the movement, legs extended at the top of the press, the cranks would rewind to the start position again, ready for another rep. The phase, "snap back resistance" or "reverse resistance" is used here to explain this feature.

The accompanying drawings, which are included to provide a further understanding of the invention and are incorporated in and constitute a part of this specification, illustrate preferred embodiments of the invention and together with the detail description serve to explain the principles of the invention. In the drawings:

For orientation in the discussion of the Figures below, it is assumed that the user is facing down, the head at the upper end of the device (at left in the Figures) and the feet at the lower end of the device, and left and right is based on user left and right hands with the user facing down. (As described, however, the present invention devices are used with two different user positions—namely: (1) stomach down/back up; and, (2) back down/stomach up). Component portions, such as angles, lengths, widths, spreads, etc. are incrementally infinitely adjustable and are only limited by the physical limitations of a user's body.

Figure 2A:
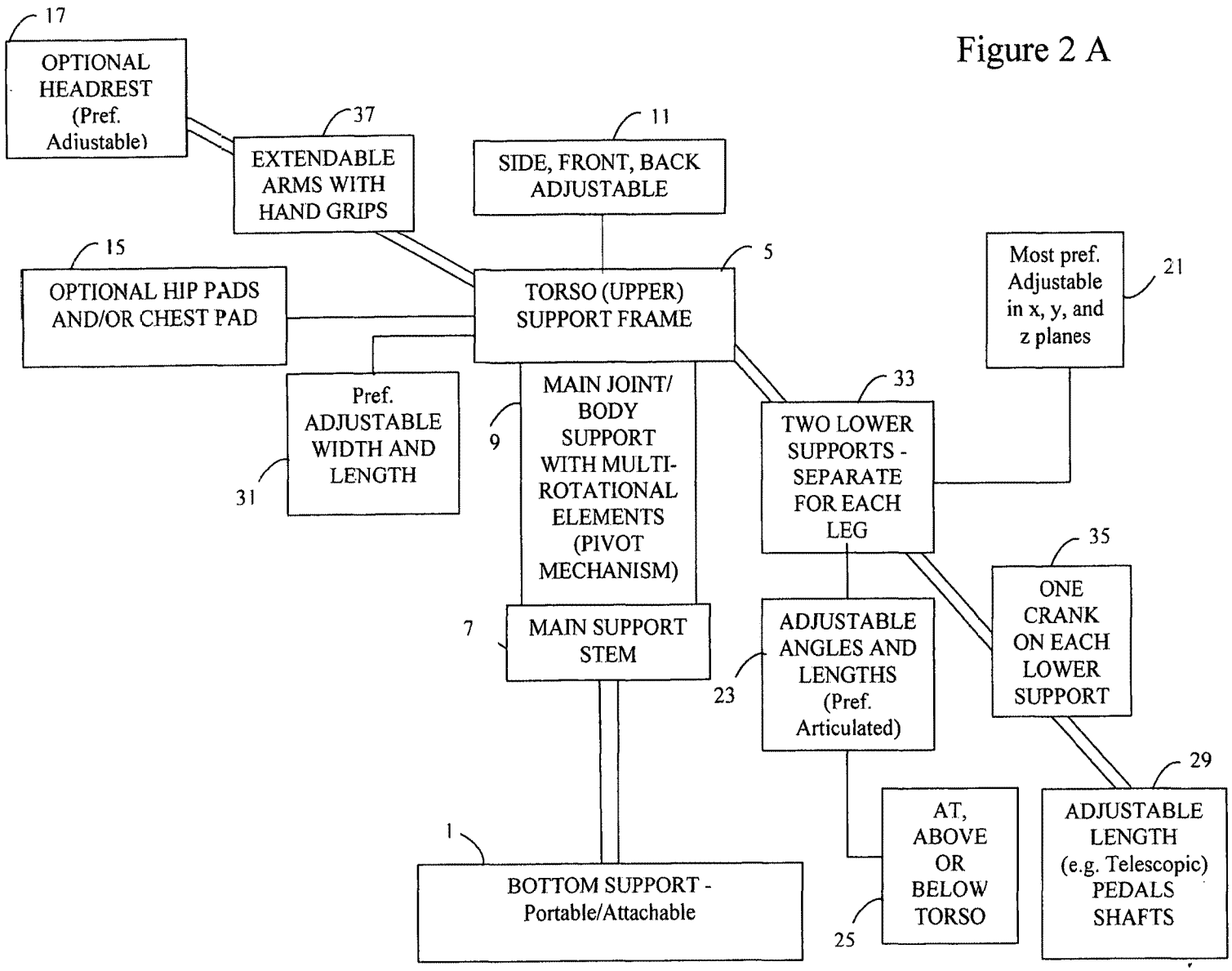
FIG. 2A is another block diagram, illustrating the essential features, other features, and preferred embodiments of the present invention exercise device, detailing FIG. 1A.

FIG. 1A is a block diagram illustrating the essential features and other features of the present invention exercise device to provide a user with advanced bench-cycling exercises as well as glute toning and abs toning, for use in both the stomach-down and stomach-up positions, and FIG. 2A is another block diagram, illustrating the essential features, other features, and preferred embodiments of the present invention exercise device. To the extent that FIGS. 1A and 2A have identical component blocks, they are identically numbered, and, as they are discussed with reference to FIG. 1A, need not be repeated in the discussion of FIG. 2A.

FIGS. 1A and 2A are now discussed simultaneously, except where indicated. In these Figures, the present invention exercise device to provide a user with advanced bench-cycling exercises as well as glute toning and abs toning, for use in both the stomach-down and stomach-up positions is illustrated from the bottom up. There is a base, which is indicated as portable or attachable, bottom support 1. By "portable" is meant that the device base moveable yet is large enough to prevent tipping in normal usage without being attached, strapped or otherwise connected or held in place; by "attachable" is meant that it is designed and structures to be attached, by any means, to a substrate, such as screwing, bolting, strapping, welding, etc. to a floor, pad or other substrate. The bottom support may extend all the way up to a pivot mechanism, shown as joint/body support 9, so it might be a table with 3 or 4 or more legs. However, in the present invention preferred embodiments, there is a base (bottom support 1) and a main support stem 7 as shown in FIG. 2. There is a torso support frame 5, also designated herein as an upper support bar. It includes optional hip pads and chest pad 15, an optional but preferred separate headrest 17 and, as generically shown in FIG. 1, handles (fixed or adjustable) 13. As shown in FIG. 2, the handles may be extendable arms with hand grips 37. This upper support bar (frame 5) may also have adjustable front, sides and back 11. These adjustable sections are expressly for the pads mentioned above. That is, while the pads are adjustable, it is understood that the underlying infrastructure itself must be adjustable so that the supporting frame of the pads will adjust.)

Figure 1B:
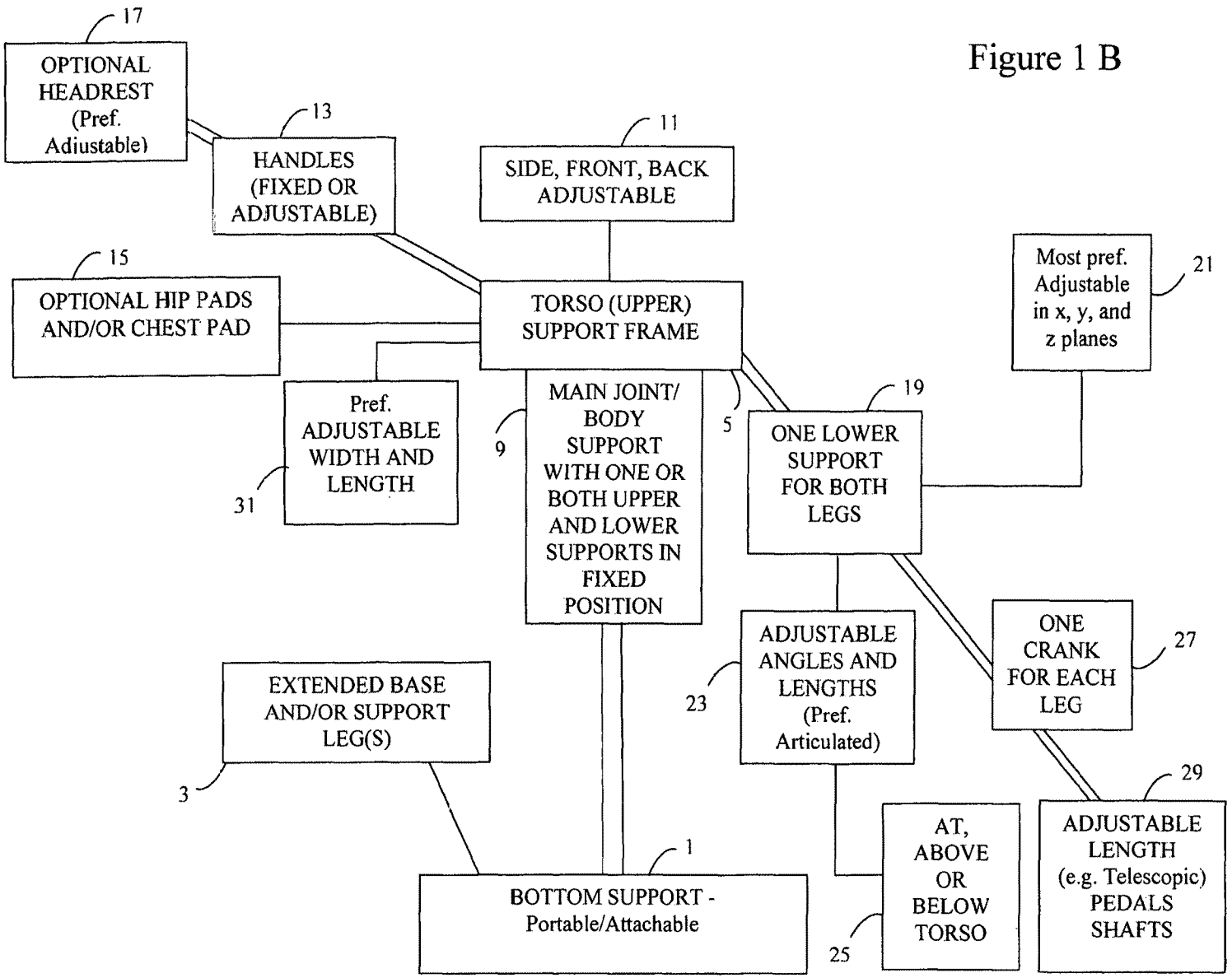
FIG. 1B is a block diagram illustrating the essential features and other features of the present invention exercise device as shown in FIG. 1A, except that one or both of the upper support bar and the lower support bar (upper section) are fixed (not rotatable in the vertical plane)
Figure 2B:
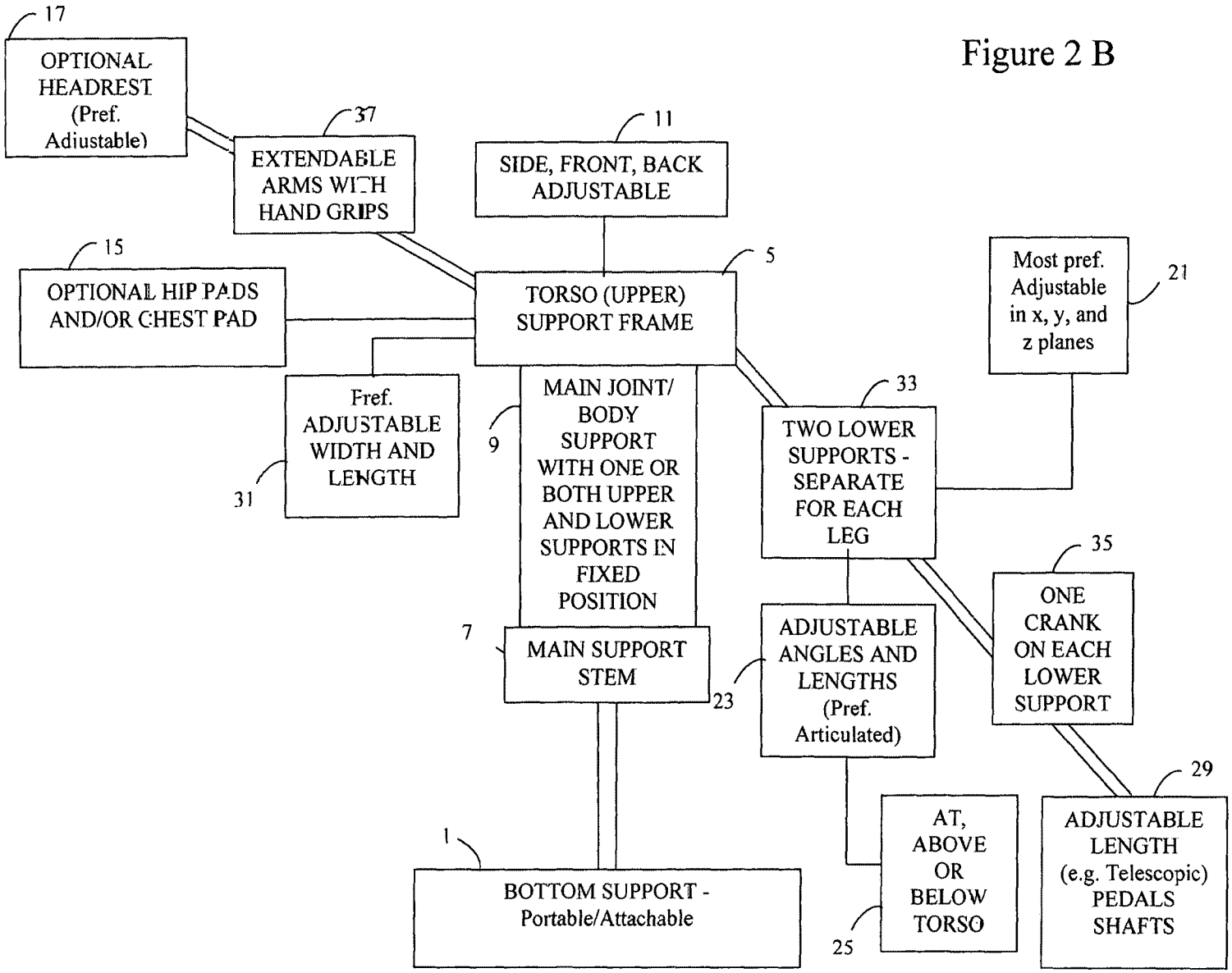
FIG. 2B is another block diagram, illustrating the essential features, other features, and preferred embodiments of the present invention exercise device, detailing FIG. 1B.

In FIG. 1, this embodiment has a single lower support for both legs 19, but in FIG. 2, our preferred embodiments, the lower support bar is a dual set of two 33. Correspondingly, in FIG. 1 there is one crank for each leg 27, both attached on opposing sides to the same, single lower support; and in FIG. 2 there is one crank on each of the lower support bars. This difference will be further illustrated below in conjunction with the drawings that follow. In both FIGS. 1 and 2, the lower supports have adjustable angles and lengths and are preferably articulated, i.e., are segmented with rotational connections, much like the human leg with a knee joint.

In both FIGS. 1A and 2A, the lower support is most preferably adjustable in three planes. In the FIG. 1A embodiments, the single lower support may preferably be rotated up and down (joint rotation), back and forth for side rotation, and telescopic for extension-contraction, hence three-dimensional rotation. Likewise, for FIG. 2A preferred embodiments, except that, here, each of the two lower supports are three dimensionally rotatable and, hence, can be spread apart from one another. Also shown in both Figures are articulated lower support members, enabling use of a "knee joint", as well as adjustable length pedals, which are achieved with telescopic crank shafts 29.

Figure 3:
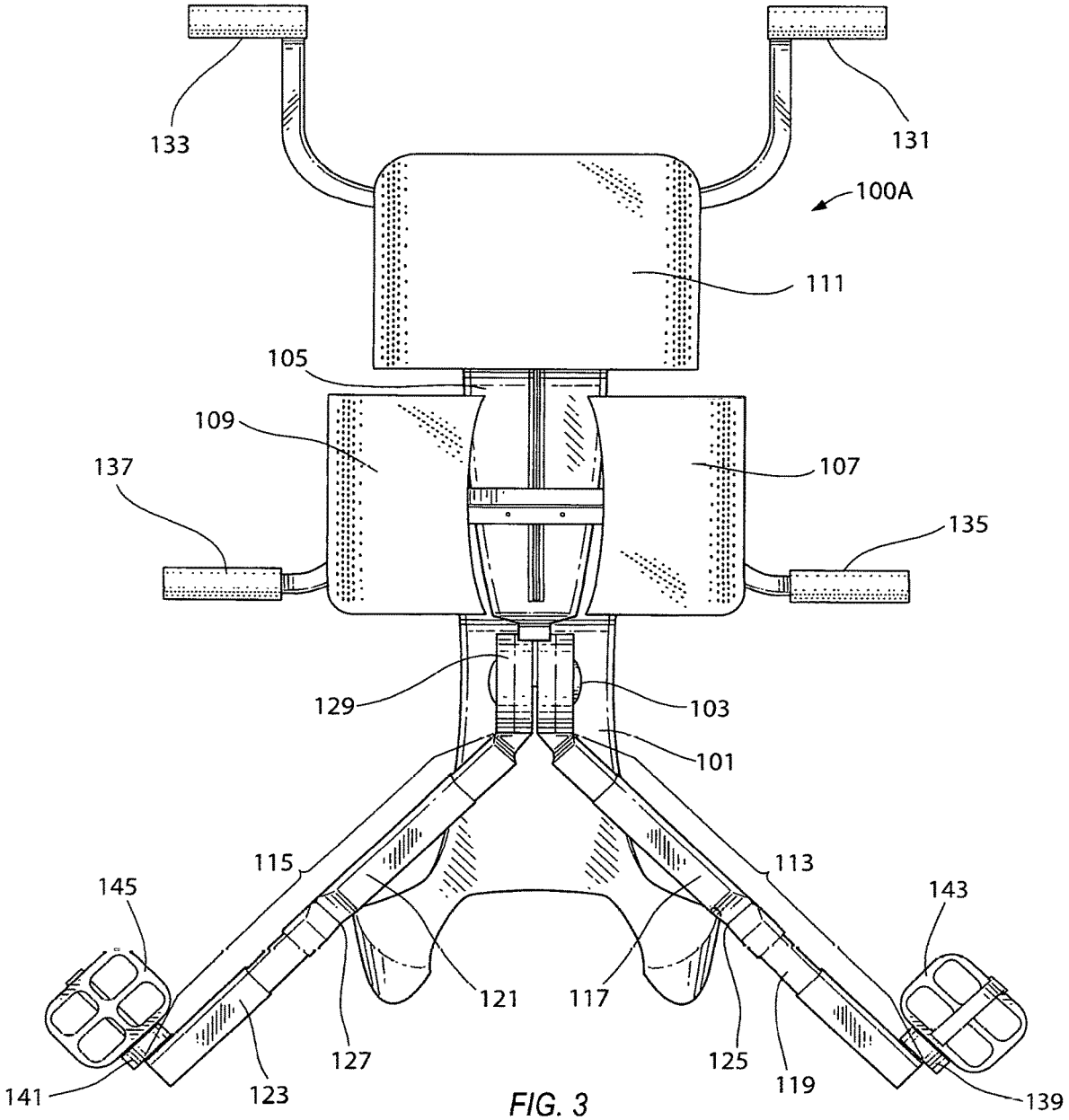
FIG. 3 shows a top view.
Figure 4:
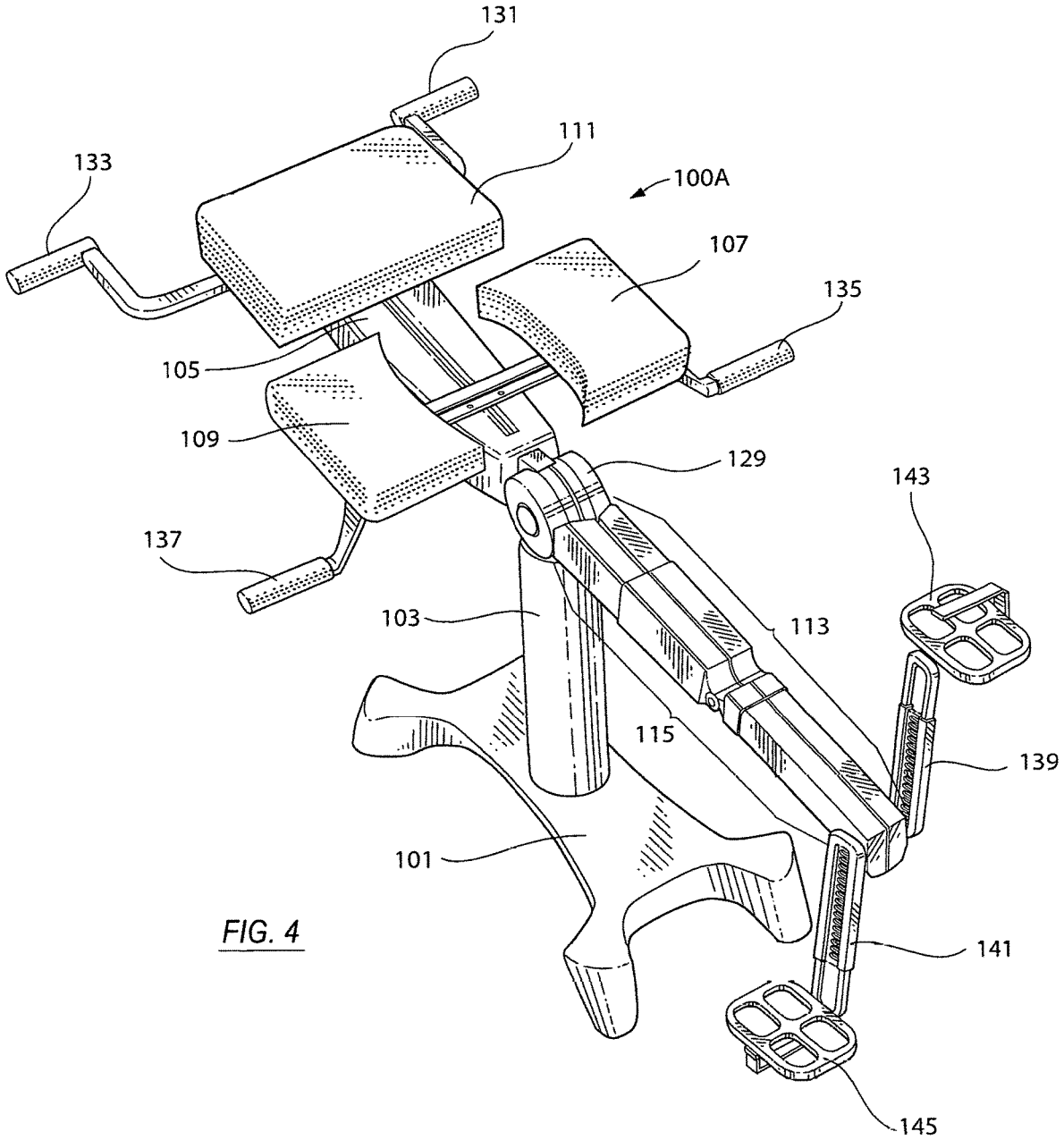
FIG. 4 shows an oblique front view.
Figure 5:
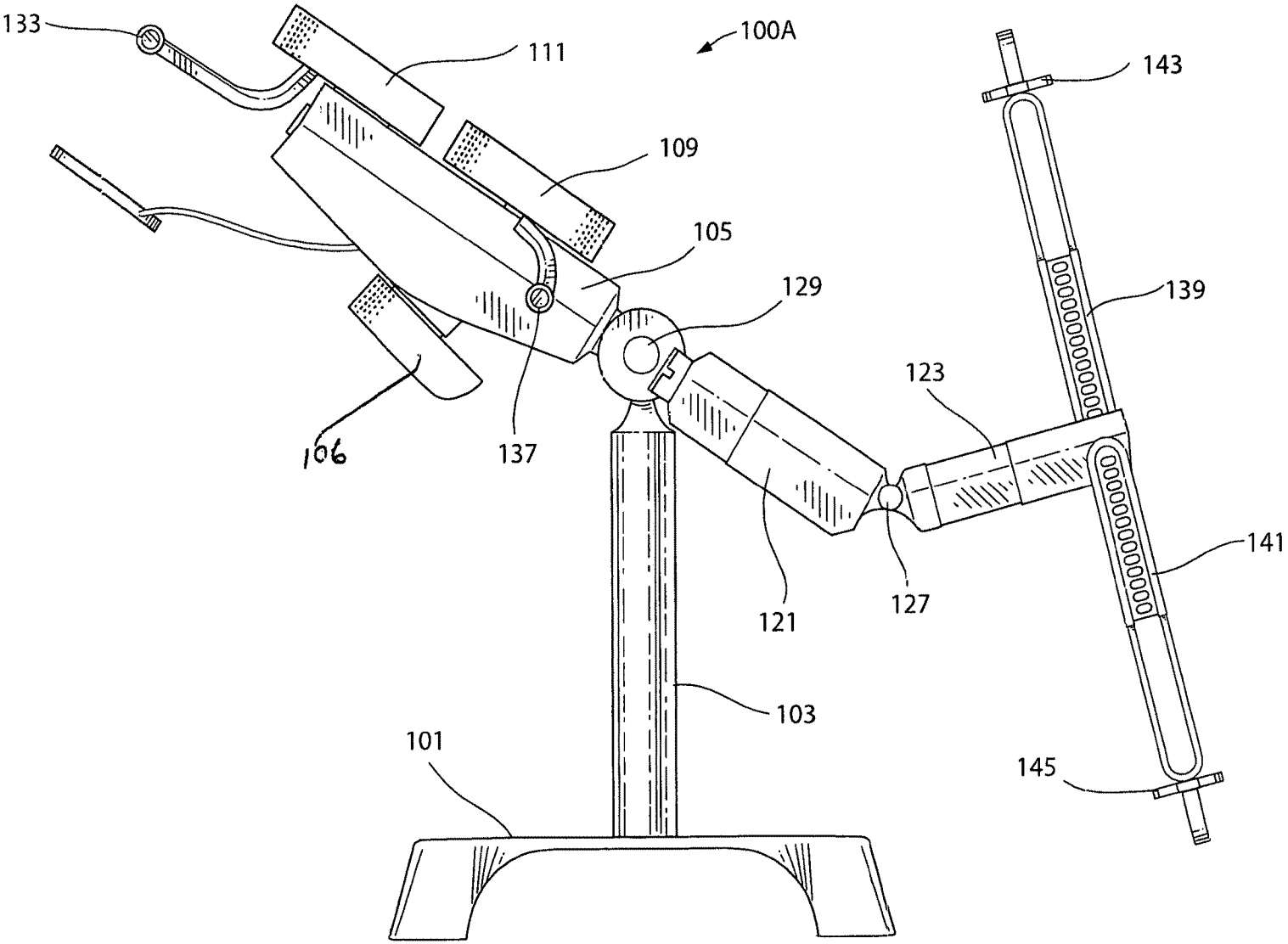
FIG. 5 shows a side view of a preferred present invention exercise device.

FIG. 3 shows a top view, FIG. 4 shows an oblique front view, and FIG. 5 shows a side view of a preferred present invention exercise device 100A. Identical components and parts have identical reference numbers. These three Figures are discussed together. There is shown a bottom support 101 (which may be attachable or portable, but here is a stand-alone portable embodiment), and a main support stem 103. The support stem has a pivot mechanism 129, which illustrated in more detail below. Connected to the pivot mechanism 129 (also referred to herein as a main joint) is torso support frame 105. This has an optional but preferred set of hip pads—a first hip pad 107 and a second hip pad 109, shown in an open position, but adjustable on sliding support frames, so as to be movable toward and away from center to accommodate larger and small users. There is also a chest/back pad 111 that moves toward and away from center on a track to also to be movable toward and away from center to accommodate larger and small users. There are also right upper handle 131, left upper handle 133 and right lower handle 135, left lower handle 137 connected to the torso support frame 105 (aka the upper support bar). Note that the handles 131 and 133 may be created of a single tubular member and also could have two locking positions, so that it could be swung down for stomach-up positions.

In this preferred embodiment of these FIGS. 3, 4 and 5, there are dual lower supports. Thus, there is shown a first lower support bar 113 and a second lower support bar 115. Each of these are articulated and telescopic. Telescopic/locking upper segment 117 of first lower support bar 113 and telescopic/locking lower segment 119 of first lower support bar 113 are shown with a rotational joint 125 therebetween. Likewise, telescopic/locking upper segment 121 of second lower support bar 115 and telescopic/locking lower segment 123 of second lower support bar 115 are shown with a rotational joint 127 connection therebetween. At the lower ends of these dual lower support bars 113 and 115, are telescopic right crank 139, telescopic left crank 141, right peddle 143 left peddle 145.

Shown in FIG. 5, is optional but preferred monitor screen cord 149 monitor device/screen 151. These are used for various purposes—music, communications, television, movies, etc. but essentially may serve one, two or preferably three purposes that relate directly to the present invention exercise device-control, monitoring and data storage. The controller function may relate to positional adjustments (doing or tracking), resistance adjustments, and controlling other functions as well. Monitoring may include display of various variables, such as resistance level, distance, time, distance/time, etc. data storage may enable a user to check on progress over multiple usages and over longer periods. And the screen may also be part of an intranet system, an internet system or both, with local and/or LD interaction. (Although this monitor device is shown as wired to the exercise device, it could be wireless and use any known mechanism for connectivity.

Also, hidden in FIGS. 3 and 4, and shown in FIG. 5 is headrest 106. Headrest 106 is shown in its retracted position, generally in this position when user is belly down. When the present invention device 100A is used in a belly-up position, the headrest 106 is deployed, that is, it is unlocked, slid away from pivot mechanism 129 and up, into an open position to hold the head of a user on his back.

Figure 6:
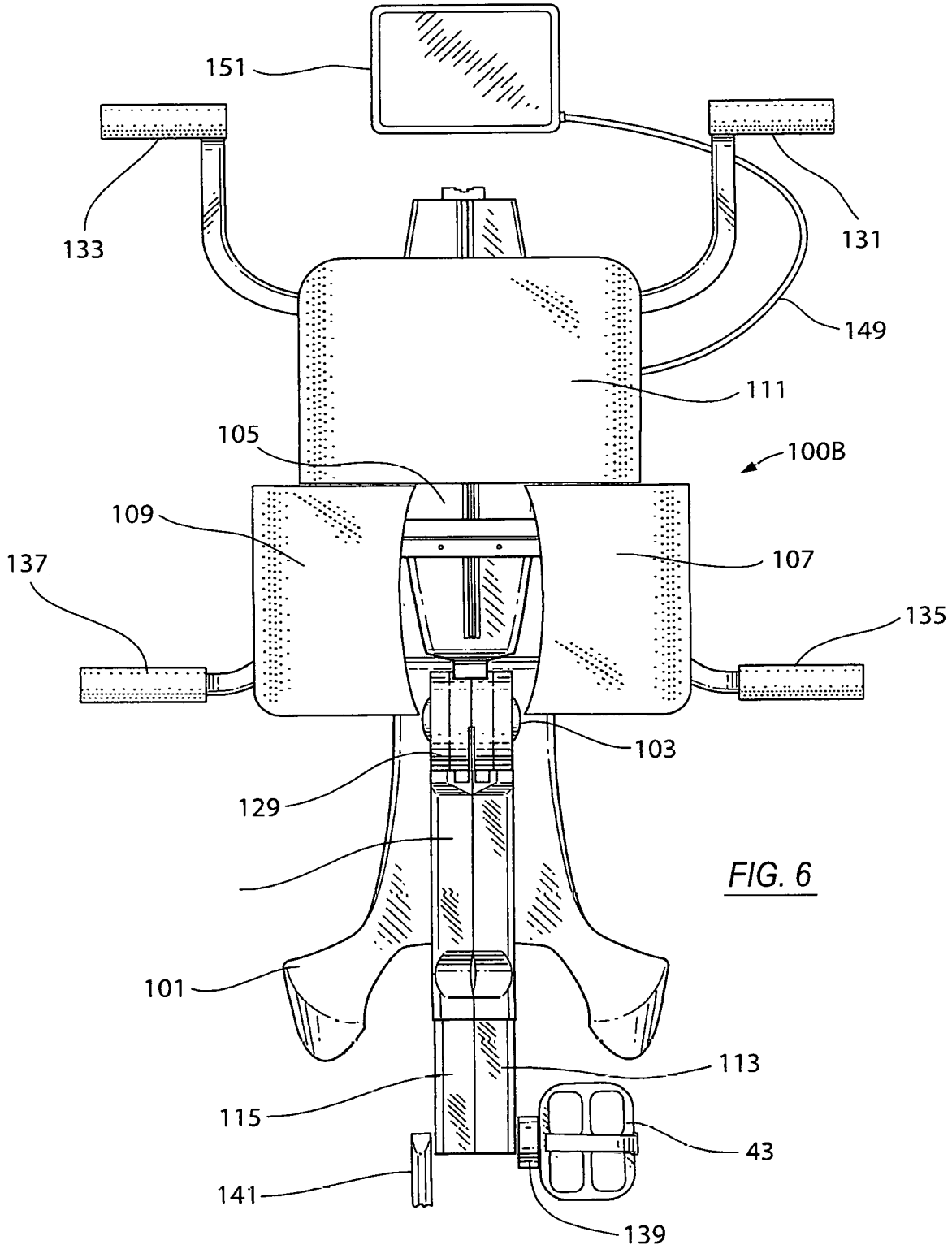
FIG. 6 shows a top view of the same preferred present invention exercise device as shown in FIG. 3 above, but with the various pads moved into their closed (contracted) positions.

FIG. 6 shows a top view of the same preferred present invention exercise device as shown in FIG. 3 above, but with the pad 111 moved into its closed (contracted) position.

Figure 7:
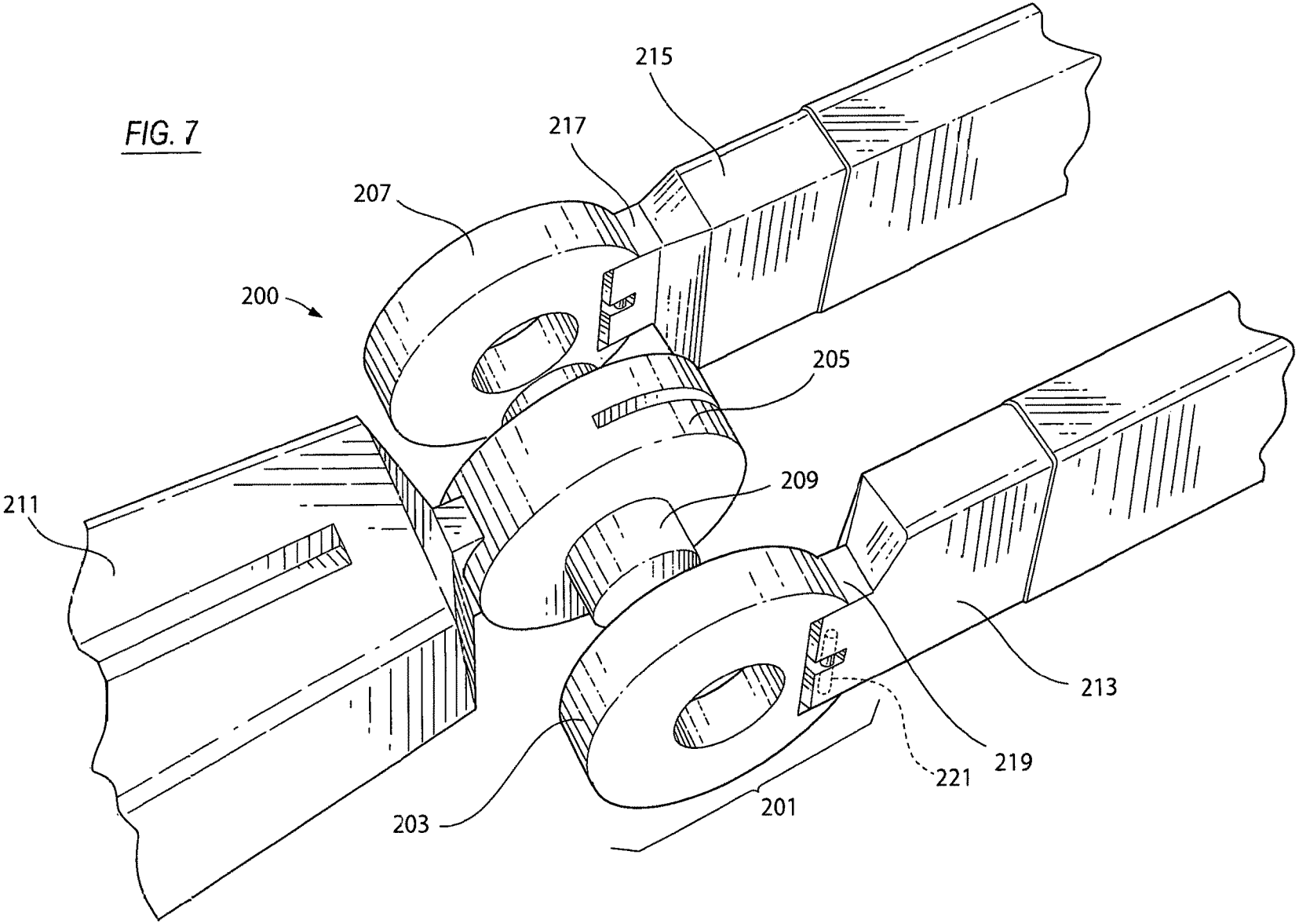
FIG. 7 illustrates an oblique, blown-up side view of one preferred embodiment of the present invention exercise device main joint with partially shown upper support bar and lower support bars attached.
Figure 8:
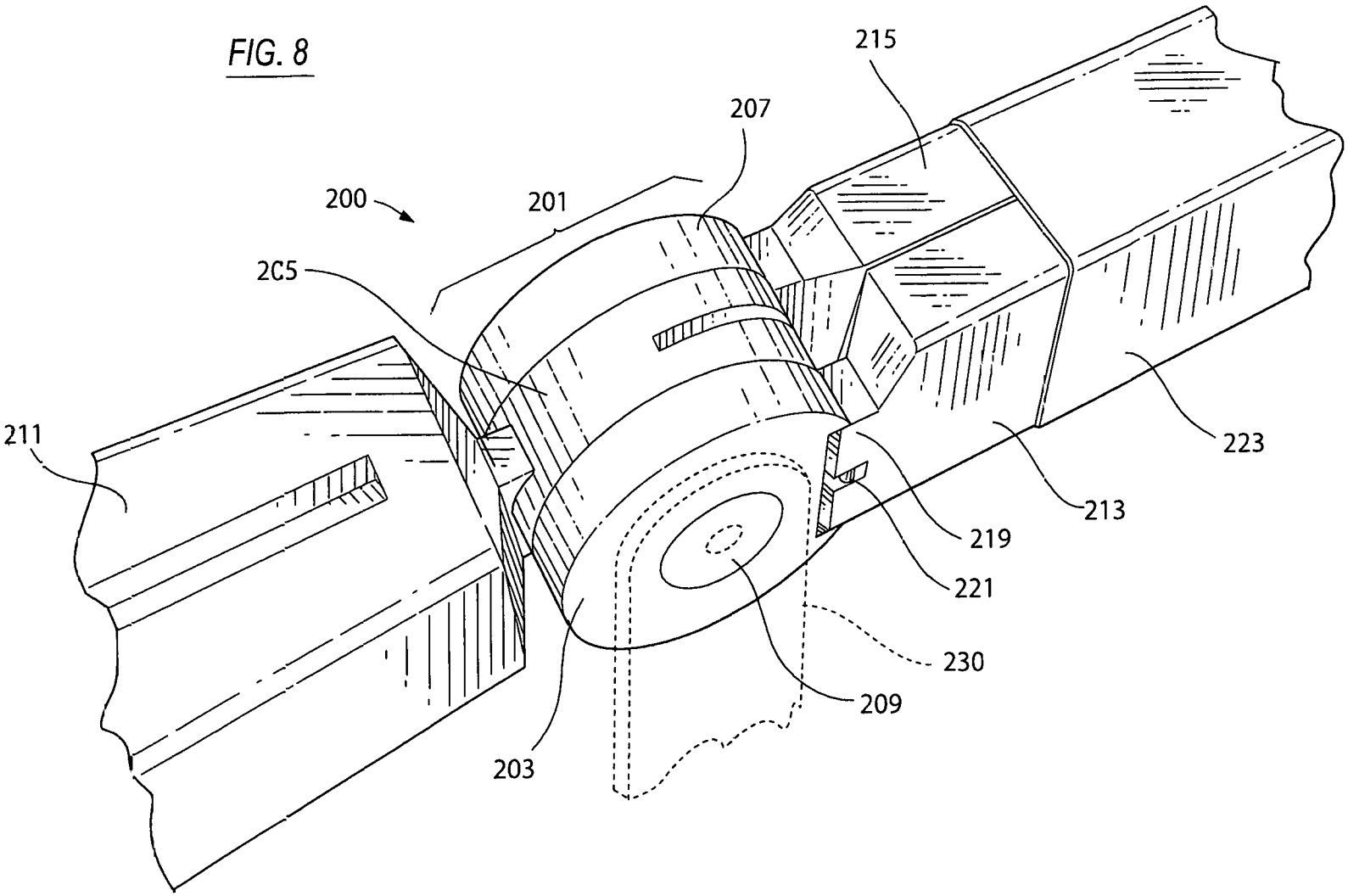
FIG. 8 shows the same components as shown in FIG. 7, but assembled and mounted.

FIG. 7 illustrates an oblique, blown-up side view of one preferred embodiment of the present invention exercise device main joint 200 with partially shown upper support bar 211 and dual lower support bars 213 and 25 attached. FIG. 8 shows the same components as shown in FIG. 7, but assembled and mounted, and, therefore are discussed together. As can be seen from both Figures, main joint 201 is a pivot mechanism that includes three rings 203, 205 and 207 and a central axle 209 upon which all three rings may independently rotate upon. By this arrangement, upper support bar 211 may be rotated up or down to accommodate a user's personal positional preferences, and each "leg", i.e., each lower support bar (in FIG. 7), may be independently rotated upwardly or downwardly. Note that in FIG. 8 these dual lower support bars are yoked with sleeve 223 to make a single lower support, so in the FIG. 8 yoked arrangement, they function as a single lower support bar. Also shown in FIG. 7 and FIG. 8 is vertical rotational axle 221 (hidden in FIG. 7 and exposed in FIG. 8), that allows each of the two lower support bars 213 and 215 to swing toward or away from each other, thus permitting the spreading arrangement to maximize extended muscle work outs.

Figure 11:
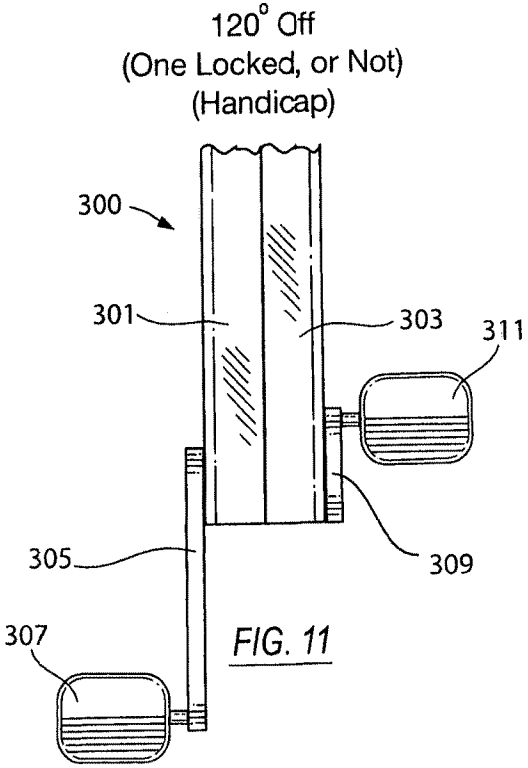
FIGS. 9, 10 and 11 illustrate end views of exemplary pedal positions relative to one another.
Figure 10:
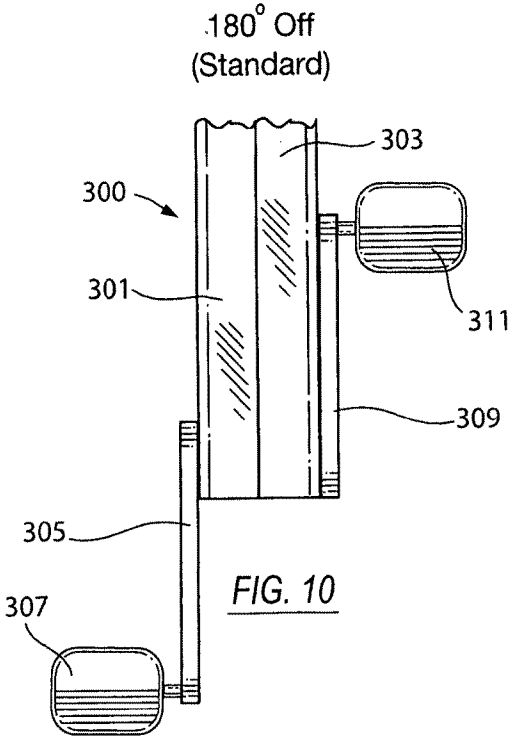
Figure 9:
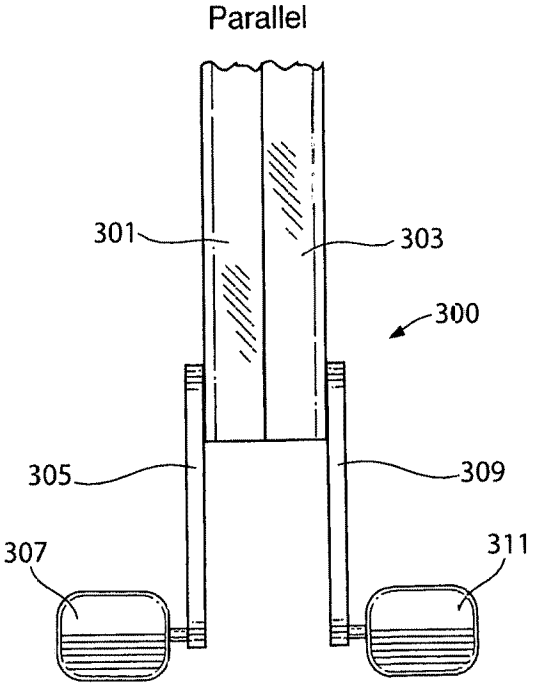
Figure 12:
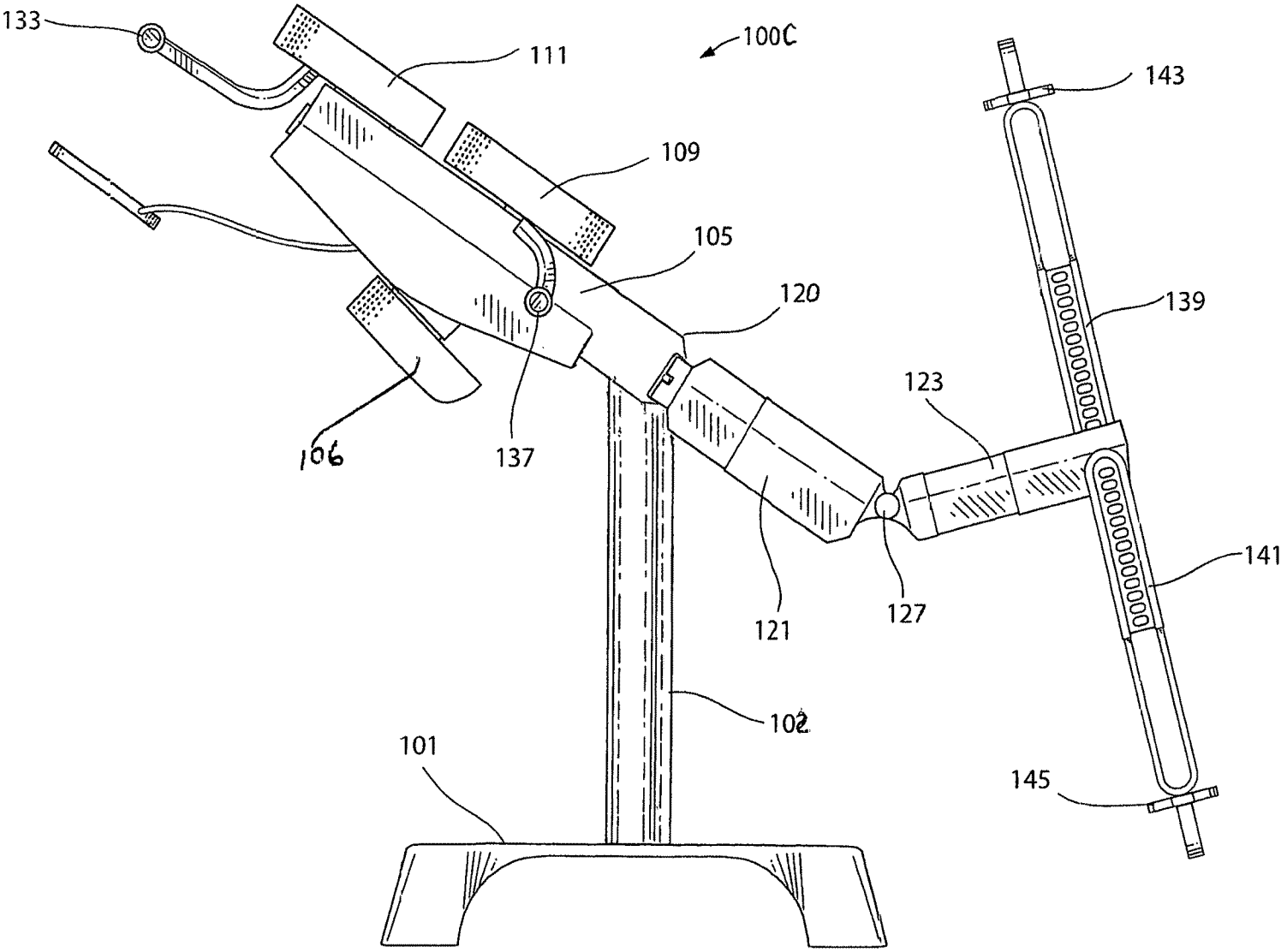
FIG. 12 shows a side view of another preferred present invention exercise device similar to that of FIG. 5, but with some body support frame joint changes.
Figure 13:
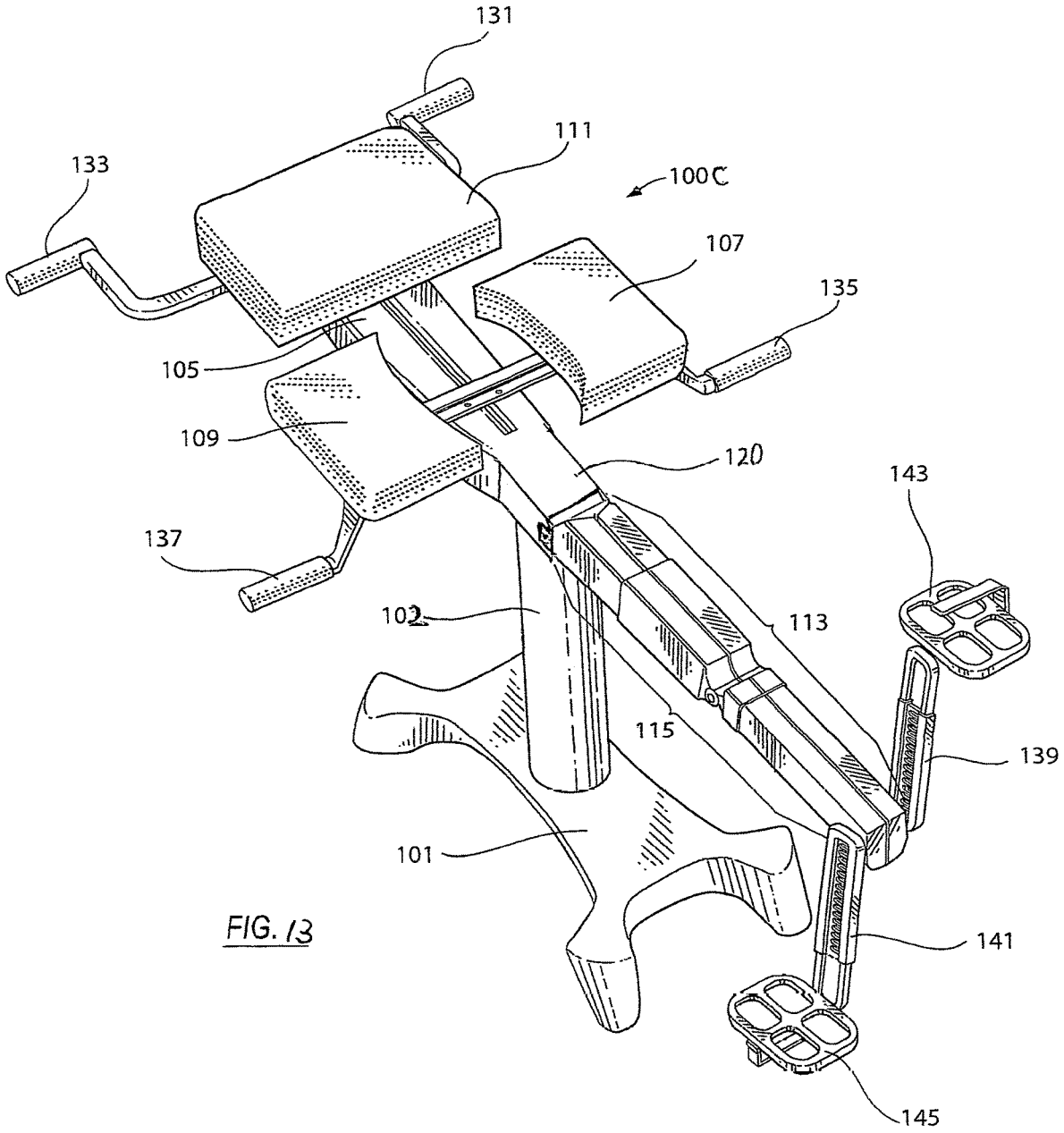
FIG. 13 shows a top oblique view of the present invention device of FIG. 12; and, FIG. 14 shows a side view of yet another preferred present invention exercise device similar to that of FIG. 5, but with some different body support frame joint changes.
Figure 14:
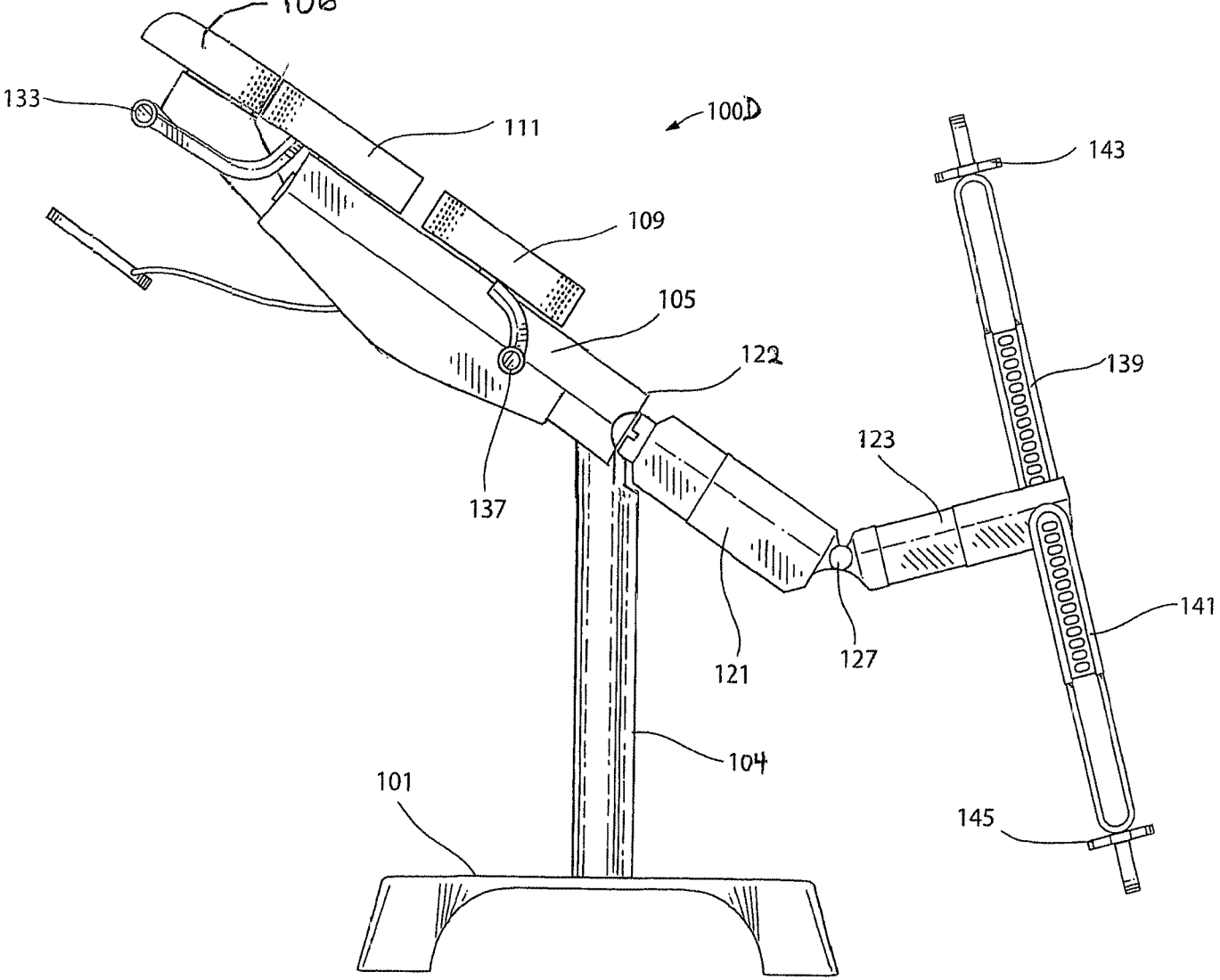

FIGS. 9, 10 and 11 illustrate end views of exemplary pedal positions relative to one another. All three Figures have identical components identically numbered. Each of these Figures shows a partial front view, with the following components or partial (cut) components: Lower portion 300 of a present invention exercise device; dual lower support bars 301 and 303; crank 305 on lower support bar 301 and crank 309 on lower support bar 303; pedal 307 on crank 305 and pedal 311 on crank 309. FIG. 9 illustrates that the pedals may be maintained in parallel. Using a clock to describe the full circle of a rep, in FIG. 9 arrangement, when pedal 307 is at 12 o'clock, so is pedal 311. When pedal 307 is at 9 o'clock, so is pedal 311. They move in parallel. FIG. 10 illustrates an arrangement where the pedal 307 and the pedals 311 are 180 degrees apart, i.e., in the same pedal relationship as pedals on a bicycle. In FIG. 11, pedal 307 and 311 are set apart by a random angle or a predetermined angle, such as 120 degrees. It should be noted that for any configuration heretofore described, on pedal may be locked in a single position and the other may be left to rotate. Such arrangements would be advantageous when working and focusing on a single area of one leg such as an injured leg of an athlete in rapid rehab, or for exercise of a handicapped person who has one leg that does not bend or is an amputee.

Resistance may be "computer controlled" on the pedals so that a user may build up strength over time. In one version, this adjustment feature may be totally controlled by the user, wherein the user sets the resistance and changes it as desired.

In another version, programs are included that set graduated resistances over usage or time (such as is measured in miles pedaled or hours used). In a third, preferred version, the user is offered both preprogrammed regimens and self-controlled resistance adjustments. The details of controlled resistance on exercise bikes are well known, and the same arrangements may be used with the present invention devices. In addition, variable resistance may be controlled on a cycle-by cycle basis, i.e., the resistance on the uphill movement of dual pedals might be lower than the resistance on a downhill portion of a stroke or cycle, or vice versa. Such changes in resistance (by tension or compression) may be smoothly transitioned or done in step functions. The cranks also have the ability to produce "radial resistance increments" that can be controlled either manually or via the computer. Radial resistance increments can be looked at like resistance applied to the movement of clock hands, standard resistance like a standard stationary bike would be resistance equally all the way around the clock. Radial resistance increments would be resistance from 12 pm-6 pm, and then none, or little resistance from 6 pm back to 12 am, or any desired increment(s) throughout the rotation. This is also useful for rehabilitation. The phrase, "radial resistance increments" is used here to explain this feature.

Although particular embodiments of the invention have been described in detail herein with reference to the accompanying drawings, it is to be understood that the invention is not limited to those particular embodiments, and that various changes and modifications may be used herein by one skilled in the art without departing from the scope or spirit of the invention as defined in the appended claims. For example, while resistance adjustment may be done "on the pad", i.e., computer controlled, alternatively, manual adjustments could be used, such as a rotatable handle and spring-rotating down tightens the spring to increase resistance and rotating up loosens the spring to reduce resistance.

What is claimed is:

1. An exercise device to provide a user with advanced bench-cycling exercises as well as glute toning, abs toning and leg muscle development, for use in both the stomach-down and stomach-up positions, and to provide X-plane, Y-plane and Z-plane adjustability, comprising:

a) a bottom support and at least one main support stem extending upwardly therefrom;

b) a main joint rotatably connected to said at least one main support stem so as to allow two separate lower support bars and an upper support bar to be tiltable;

c) said upper support bar having sufficient size to support at least a portion of a human torso of said user, said upper support bar being rotatably connected to said main joint;

d) said two separate lower support bars that are adjustable in length, each of said two separate lower support bars having a top portion connected to one of said upper support bar, said main joint, and said at least one support stem; wherein each of said two separate lower support bars having a bottom portion extended away from said upper support bar, and wherein each of said two separate lower support bars having independent rotational mechanisms for movement in said X-plane, Y-plane and Z-plane for three dimensional adjustability and for angle changes between each of said two separate lower support bars;

e) two cranks located on said bottom portions of said two separate lower support bars; and f) a pair of pedals separately connected to each of said two cranks, wherein each of said cranks is adjustable in length.

2. The exercise device of claim 1, wherein the upper support bar includes at least one of: a) expandable, contractable sides, and b) an expandable top.

3. The exercise device of claim 1, wherein the upper support bar includes a headrest, and includes extended arms with hand grips.

4. The exercise device of claim 1, wherein the at least one main support stem includes a swivel connection to permit at least the upper support bar to swivel relative to the at least one main support stem.

5. The exercise device of claim 4, wherein the upper support bar extended arms have at least two positions, one being a contracted position and one being a protracted position relative to the torso support frame.

6. The exercise device of claim 1, wherein the top portion and bottom portion of each of said two separate lower support bars form two bar segments that are lockably articulated relative to one another by a knee joint that permits different angles and positions between the two bar segments.

7. The exercise device of claim 1, wherein each of the two lower support bars is connected to one of: the upper support bar, main joint, and said at least one support stem, with a rotatable and lockable ring of said independent rotational mechanisms for rotational movement thereof relative to the upper support bar.

8. The exercise device of claim 1, wherein each crank is lockably telescopic and each pedal is independently lockable at any angle, relative to the other pedal.

9. The exercise device of claim 1, wherein said exercise device further includes a display configured to display a pedal distance and a monitored resistance.

10. The exercise device of claim 9, wherein said exercise device further includes a memory for storing and retrieving said pedal distance and monitored resistance.

11. An exercise device to provide a user with advanced bench-cycling exercises as well as glute toning, abs toning and leg muscle development, for use in both the stomach-down and stomach-up positions, comprising:

a) a bottom support and at least one main support stem extending upwardly therefrom;

b) a main joint connected to said at least one main support stem;

c) an upper support bar having sufficient size to support at least a portion of a human torso of said user, said upper support bar being connected to said main joint;

d) at least one lower support bar that is adjustable in length, said at least one lower support bar having a top portion connected to one of said main joint and body support frame, said upper support bar, and said at least one support stem; and wherein said at least one lower support bar having a bottom portion extended away from said main joint, and wherein said top portion and said bottom portion form two bar segments that are lockably articulated relative to one another by a knee joint that permits different angles and positions between the two bar segments;

e) two cranks located on said bottom portion of said at least one lower support bar; and f) a pair of pedals separately connected to each of said two cranks, wherein each of said cranks is adjustable in length.

12. The exercise device of claim 11, wherein said main joint is rotatably connected to said at least one main support stem so as to allow said at least one lower support bar and said upper support bar be tiltable.

13. The exercise device of claim 11, wherein said main joint is fixedly connected to said at least one main support stem, so as to prohibit rotational movement of at least one of: said at least one lower support and said upper support bar.

14. The exercise device of claim 11, wherein the upper support bar includes at least one of: a) expandable, contractable sides, and b) an expandable top.

15. The exercise device of claim 11, wherein the upper support bar includes a headrest, and includes extended arms with hand grips.

16. The exercise device of claim 15, wherein said extended arms also include elbow support pads.

17. The exercise device of claim 16, wherein the upper support bar extended arms have at least two positions, one being a contracted position and one being a protracted position relative to the upper support bar, to accommodate stomach-down use and stomach-up use.

18. An exercise device to provide a user with advanced bench-cycling exercises as well as glute toning, abs toning and leg muscle development, for use in both the stomach-down and stomach-up positions, comprising:

a) a bottom support and at least one main support stem extending upwardly therefrom;

b) a main joint and body support frame connected to said at least one main support stem;

c) an upper support bar having sufficient size to support at least a portion of a human torso of said user, said upper support bar being connected to said main joint;

d) at least one lower support bar that is adjustable in length, said at least one lower support bar having a top portion connected to one of said main joint, said upper support bar, and said at least one support stem, with a rotatable and lockable ring for rotational movement thereof relative to the upper support bar, and wherein said at least one lower support bar having a bottom portion extended away from said main joint;

e) two cranks located on said bottom portion of said lower support bar; and f) a pair of pedals separately connected to each of said two cranks, wherein each of said cranks is adjustable in length.

19. The exercise device of claim 18, wherein said main joint is rotatably connected to said at least one main support stem so as to allow at least one of said lower support and upper support bars to be tiltable.

20. The exercise device of claim 18, wherein said main joint is fixedly connected to said at least one main support stem, so as to prohibit rotational movement of at least one of: said at least one lower support and said upper support bar.

* * * * *